US008926299B2

(12) United States Patent
Watanabe et al.

(10) Patent No.: US 8,926,299 B2
(45) Date of Patent: Jan. 6, 2015

(54) PUMP DEVICE

(75) Inventors: Manabu Watanabe, Gunma-ken (JP); Junichi Miyajima, Gunma-ken (JP); Masato Izutsu, Gunma-ken (JP); Takatoshi Watanabe, Gunma-ken (JP)

(73) Assignee: Yamada Manufacturing Co., Ltd., Kiryu-Shi, Gunma-Ken (JP)

( * ) Notice: Subject to any disclaimer, the term of this patent is extended or adjusted under 35 U.S.C. 154(b) by 339 days.

(21) Appl. No.: 13/426,554

(22) Filed: Mar. 21, 2012

(65) Prior Publication Data

US 2012/0244027 A1 Sep. 27, 2012

(30) Foreign Application Priority Data

Mar. 27, 2011 (JP) ..... 2011-69048
Jan. 18, 2012 (JP) ..... 2012-7754

(51) Int. Cl.
*F04C 14/18* (2006.01)
*F04C 2/14* (2006.01)

(52) U.S. Cl.
CPC ..... *F04C 2/14* (2013.01); *F04C 14/185* (2013.01)
USPC ..... 418/21

(58) Field of Classification Search
CPC ..... F04C 2/18; F04C 14/185
USPC ..... 417/212; 418/17, 19, 21
See application file for complete search history.

(56) References Cited

U.S. PATENT DOCUMENTS 3,054,356 A * 9/1962 Thompson ..... 418/195
2003/0147758 A1* 8/2003 Havlik et al. ..... 417/310
2006/0104823 A1* 5/2006 Hunter et al. ..... 417/44.2
2007/0111855 A1* 5/2007 Voigt ..... 477/156
2010/0098572 A1* 4/2010 Rago ..... 418/206.1

FOREIGN PATENT DOCUMENTS

JP 2007-514097 A 5/2007

OTHER PUBLICATIONS

WO2006/129169A1: Armenio, Giacomo, Jul. 2006.*

* cited by examiner

*Primary Examiner* — Devon Kramer
*Assistant Examiner* — Patrick Hamo
(74) *Attorney, Agent, or Firm* — McGinn IP Law Group, PLLC

(57) ABSTRACT

The invention has: a housing; a pump section formed of a drive gear unit and a driven gear unit; a main flow channel through which oil pressure is applied to the driven gear unit in a discharge volume reduction direction; a first branching flow channel through which oil pressure that assists oil pressure from the main flow channel is applied; a second branching flow channel through which oil pressure is applied to the driven gear unit in a discharge increase direction; a first flow channel control section; a second flow channel control section; and a spring that elastically urges the driven gear unit in a discharge increase direction. The first flow channel control section and the second flow channel control section can perform switching control in accordance with each increase or decrease of engine revolutions and in pressure.

17 Claims, 15 Drawing Sheets

VIEW FROM 2B-2B

VIEW FROM 2D-2D

C
6
63
61c
322
64
61d
61b
61a
61f
321
61e
D
34
7
33
72
332
82
71
331
341

[LOW REVOLUTION RANGE]

FIRST BRANCHING FLOW CHANNEL →SHUT OFF ⇒ORDINARY DISCHARGE VOLUME
SECOND BRANCHING FLOW CHANNEL →COMMUNICATES
DRIVEN GEAR UNIT →MOVES

FIRST EMBODIMENT

[HIGH REVOLUTION RANGE]
FIRST BRANCHING FLOW CHANNEL → SHUT OFF
SECOND BRANCINGFLOW CHANNEL → COMMUNICATES
DRIVEN GEAR UNIT → MOVES
⇒ DISCHARGE VOLUME INCREASES

FIRST EMBODIMENT

[HIGH REVOLUTION RANGE]
FIRST BRANCHING FLOW CHANNEL → SHUT OFF
SECOND BRANCINGFLOW CHANNEL → SHUT OFF
DRIVEN GEAR UNIT → MOVES
⇒ DISCHARGE VOLUME DECREASES

FIRST EMBODIMENT

[MEDIUM REVOLUTION RANGE]
FIRST BRANCHING FLOW CHANNEL → COMMUNICATES
SECOND BRANCING FLOW CHANNEL → SHUT OFF
DRIVEN GEAR UNIT → MOVES
⇒ DISCHARGE VOLUME DECREASES

[SECOND-HALF STAGE IN REACHING HIGH REVOLUTION RANGE]
FIRST BRANCHING FLOW CHANNEL → SHUT OFF
SECOND BRANCHING FLOW CHANNEL → COMMUNICATES ⇒ DISCHARGE VOLUME INCREASES FURTHER
DRIVEN GEAR UNIT → MOVES FURTHER

SECOND EMBODIMENT

[HIGH REVOLUTION RANGE]
FIRST BRANCHING FLOW CHANNEL → SHUT OFF
SECOND BRANCHING FLOW CHANNEL → SHUT OFF
DRIVEN GEAR UNIT → MOVES
⇒ DISCHARGE VOLUME DECREASES

COMMUNICATES
9
33
91
332
82
92
93
331

9
33
332
82
92
93
331
91

COMMUNICATES
OPEN TO ATMOSPHERE
9
33
93
332
82
92
331
91

OPEN TO ATMOSPHERE
33
332
82
9
92
331
93
91

PUMP DEVICE

BACKGROUND OF THE INVENTION

1. Field of the Invention

The present invention relates to a pump device, in which in a variable capacity pump the pressure and discharge volume of oil are increased gradually in accordance with a value required by an engine or hydraulic equipment, and the load acting on the pump, the engine and so forth can be kept to a minimum.

2. Description of the Related Art

The theoretical discharge volume of a gear pump is determined ordinarily by, among other factors, tooth length and tooth width, and the discharge volume is determined by the theoretical discharge volume and the rotational speed of the gears (pump revolutions). In a case where such a gear pump is used, for instance, as an oil pump for supplying lubricating oil into an engine for vehicles, the theoretical discharge volume of the oil pump is set in such a manner that the necessary amount of oil can be supplied also when the output of the engine, as a driving source, is low and pump revolutions are low.

When pump revolutions increase accompanying higher engine output, on the other hand, an excessive amount of oil, beyond the required amount, may in some instances be supplied to the engine, and the oil pump may consume thus substantial driving force, which may result engine output loss. Known gear pumps that solve the above problem include variable-capacity gear pumps in which either a drive gear or a driven gear, or both, moves in the axial direction as pump revolutions increase, so that a meshing area decreases as a result, and the theoretical discharge volume is reduced accordingly.

Conventional external gear pumps have been disclosed wherein a driven gear moves in the axial direction, whereby a meshing area (axial-direction height) is modified; as a result, the theoretical discharge volume varies proportionally to the meshing area between a drive gear and the driven gear. One such pump is disclosed in JP-T-2007-514097. An overview of the features in JP-T-2007-514097 follows next. The reference numerals of members in the following explanation are as used in JP-T-2007-514097. Specifically, the external gear pump of JP-T-2007-514097, as illustrated in FIG. 1 of that document, comprises a first conveying gear 5 (drive gear) and a second conveying gear 6 (driven gear).

A spring piston 9 is disposed on the left of the second conveying gear and a pressure piston 8 is disposed on the right. The second conveying gear is coupled to the pistons on both sides, by way of a journal bolt 7, to form a displacement unit 10. The meshing area of the conveying gears 5 and 6 is modified, and the pump conveyance volume is likewise modified, through displacement of the displacement unit 10 in the axial direction. The displacement of the displacement unit 10 in the axial direction depends on an external force that acts on the displacement unit 10.

That external pressure is in the form of operational oil pressure, supplied to a chamber 11, and which acts on the pressure piston 8. The force from a reset spring 12, as well as control pressure from the control piston 1 and that is supplied to a spring chamber 13, act also thereon. In a working example of FIG. 5 of JP-T-2007-514097, a control piston 1 of FIG. 1 of this patent document is arranged inside a displacement unit 60.

In FIG. 5 of JP-T-2007-514097, an electromagnetic valve 93 is disposed in a conduit 92 that supplies operational oil pressure in a chamber 66 on a side of the displacement unit 60 opposite to the side at which a reset spring 67 is present. The electromagnetic valve 93 closes upon a rise in the operational oil pressure as given by an engine control device. At the same time, the pressure in a chamber 66 is reduced via a connection piece 94. As a result of the rise in the operational oil pressure, the reset spring 67 causes the displacement unit 60 to move to a position of highest conveyance volume.

Herein, the operational oil pressure in the chamber 66 on a side of the displacement unit 60 opposite to the side at which the reset spring 67 is present corresponds to the oil pressure exerted through switching of the electromagnetic valve 93, or to a reduction of the pressure in the chamber 66, via the connection piece 94, through closing of the electromagnetic valve 93. In such a configuration, however, the only control that is possible is between a state in which oil pressure is acting, and a state in which it is not. Therefore, the extent by which the displacement unit 60 slides in the axial direction cannot be controlled finely over multiple stages.

As a result, the displacement unit 60 cannot be displaced to a slide position at which a discharge volume and oil pressure are generated in accordance with the oil discharge volume and oil pressure that are required by the engine or hydraulic equipment, in various revolution ranges. Also, an oil discharge volume and oil pressure that are equal to or greater than required are generated in a given revolution range. This results in inefficient changeover.

SUMMARY OF THE INVENTION

Upon reduction of pressure in the chamber 66, moreover, the force of oil pressure that resists the reset spring 67 is insufficient. As a result, the displacement unit 60 cannot slide promptly, and changeover response is poor. Therefore, an object (technical problem to be solved) of the present invention is to provide a pump device in which oil pressure and discharge volume are gradually increased in accordance with values required by an engine or hydraulic equipment, so that the load exerted on the pump, the engine and so forth are can be kept to a minimum.

As a result of diligent research directed at solving the above problem, the inventors found that the problem is solved by a first invention being a pump device that has: a housing; a pump section, a discharge volume of which can be increased and reduced, and which has a drive gear unit that is immobile in an axial direction and a driven gear unit that is movable in the axial direction; a main flow channel through which oil pressure is applied to the driven gear unit in a discharge volume reduction direction; a first branching flow channel through which oil pressure that assists oil pressure from the main flow channel is applied; a second branching flow channel through which oil pressure is applied to the driven gear unit in a discharge increase direction; a first flow channel control section that controls flow in the first branching flow channel; a second flow channel control section that controls flow in the second branching flow channel; and a spring that elastically urges the driven gear unit in the discharge increase direction, wherein the first flow channel control section and the second flow channel control section perform control so as to switch between communication and shut-off between the first branching flow channel and the second branching flow channel in accordance with an increase or decrease in engine revolutions and an increase or decrease in pressure.

The above problem was solved by a second invention wherein, in the pump device of the first invention, the driven gear unit has: a small-diameter passage section in which there is disposed a valve piston that has a small-diameter section having a main pressure-receiving surface and a large-diameter section having a auxiliary pressure-receiving surface, with the small-diameter section being disposed in a driven gear unit chamber of the housing; and a large-diameter passage section in which the large-diameter section is disposed, and wherein the first branching flow channel communicates with the large-diameter passage section in a manner that oil pressure can be applied to the auxiliary pressure-receiving surface, and the second branching flow channel communicates with a drive gear unit chamber in a manner that oil pressure can be applied to a return pressure-receiving surface, which is an axial-direction end portion of the driven gear unit.

The above problem was solved by a third invention, wherein, in the pump valve device of the first or second invention, the first flow channel control section is provided with a solenoid valve and performs flow channel control of communication or shut-off of a first branching flow channel by way of the solenoid valve, and the second flow channel control section is provided with a spool valve, and performs flow channel control of communication or shut-off of a second branching flow channel by way of the spool valve.

The above problem was solved by a fourth invention wherein, in the pump device of any one of the first, second or third invention, the driven gear of the driven gear unit is formed to have an axial-direction total length dimension that is greater than that of a drive gear of the drive gear unit. The above problem was solved by a fifth invention wherein the pump device of the third or fourth invention has a configuration such that, in a changeover operation in which a switchover is performed between increasing and decreasing the discharge volume at the pump section in a first stage and a second stage, a first stage changeover is performed through switching control of the spool valve of the second flow channel control section based on oil pressure, and a second stage changeover is performed through switching control of the solenoid valve of the first flow channel control section based on engine revolutions.

The above problem was solved by a sixth invention wherein the pump device of the third or fourth invention has a configuration such that, in a changeover operation in which a switchover is performed between increasing and decreasing the discharge volume at the pump section in a first stage and a second stage, a first stage changeover is performed through switching control of the spool valve of the second flow channel control section based on oil pressure, and a second stage changeover is performed through switching control of the solenoid valve of the first flow channel control section based on engine revolutions, and through switching control of the spool valve of the second flow channel control section based on oil pressure.

In the pump section of variable capacity type of the first invention, where the pump section has the driven gear unit that that is movable, in the axial direction, with respect to the drive gear unit that is immobile in the axial direction, motion of the driven gear unit in the axial direction is elicited by the first flow channel control section and the second flow channel control section. The oil discharge volume can be thus rendered optimal in accordance with the operating conditions of the engine or hydraulic equipment. In particular, optimal discharge volumes can be achieved for a low revolution range, medium revolution range and high revolution range of the engine.

In the second invention, the driven gear unit is provided with the valve piston that comprises the small-diameter section having the main pressure-receiving surface, and the large-diameter section having the auxiliary pressure-receiving surface. Thereby, the pressure-receiving surface for the pressure of oil that flows from the main flow channel and the first branching flow channel is divided into two surfaces. The first flow channel control section performs switching between communication and shut-off of the first branching flow channel. At the time where the first branching flow channel is communicating, oil pressure acting on the auxiliary pressure-receiving surface from the first branching flow channel is added to the oil pressure acting on the main pressure-receiving surface from the main flow channel; as a result, the driven gear unit can move quickly in a direction of reducing the discharge volume, and the above-described operation can be controlled promptly, so that changeover response can be improved.

Also, the driven gear unit can be caused to move, in the direction of increasing the discharge volume, by the second branching flow channel and the second flow channel control section, together with the spring. Efficient changeover can be thus performed by configuring the first flow channel control section and the second flow channel control section so as to operate based on oil pressure or based on discharge volume.

In the third invention, the first flow channel control section is provided with the solenoid valve and performs flow channel control of communication or shut-off of the first branching flow channel by way of the solenoid valve, and the second flow channel control section is provided with the spool valve, and performs flow rate control of communication or shut-off of the second branching flow channel by way of the spool valve. By virtue of this configuration, communication and shut-off between the large-diameter passage section of the driven gear unit chamber and the first branching flow channel is performed instantly, so that the discharge volume can be reduced quickly in accordance with the operation condition of the engine and hydraulic equipment.

In the second flow channel control section, likewise, communication and shut-off between oil in the driven gear unit chamber and the second branching flow channel takes place instantly, so that the discharge volume can be increased quickly in accordance with the operation condition of the engine and hydraulic equipment.

In the fourth invention, the driven gear of the driven gear unit is formed to have an axial-direction total length dimension that is greater than that of a drive gear of the drive gear unit. As a result, the corners of the driven gear jut beyond those of the drive gear, and hence the driven gear can slide smoothly, without the corners of the latter biting onto the drive gear, as the driven gear starts sliding.

In the fifth invention, the timing of the first stage changeover is controlled through switching control of the spool valve based on oil pressure. As a result, changeover can be performed at an appropriate oil pressure, independently from oil temperature. The timing of the second stage changeover is controlled through switching control of the solenoid valve based on engine revolutions. As a result, changeover can be performed at the required timing, in accordance with the operating conditions of the engine. In the sixth invention, the timing of the second stage changeover is controlled through switching control of the solenoid valve based on engine revolutions and through switching control of the spool valve based on oil pressure. As a result, oil pressure can be raised reliably up to the required oil pressure.

DESCRIPTION OF THE PREFERRED EMBODIMENTS

Figure 1:
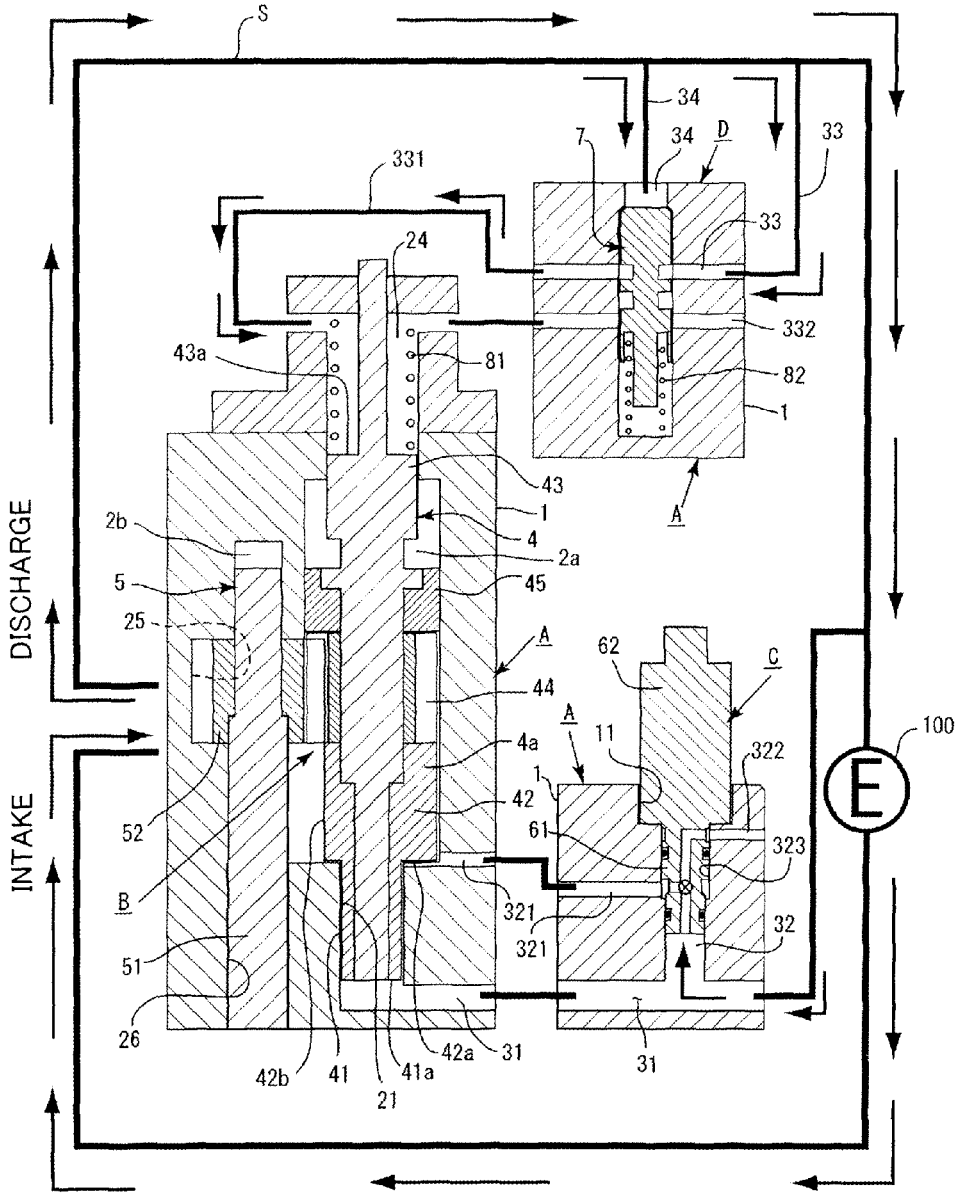
FIG. 1 is a cross-sectional diagram illustrating the configuration of a first embodiment of the present invention and illustrating an oil supply circuit of an engine.

Embodiments of the present invention are described below with reference to accompanying drawings. The present invention has a first embodiment and a second embodiment depending on the configuration and operation. The configuration in the present invention includes mainly a housing A, a gear pump section B, a first flow channel control section C and a second flow channel control section D, as illustrated in FIG. 1 to FIG. 3. The gear pump section B comprises a driven gear unit 4 and a drive gear unit 5.

The first flow channel control section C comprises a solenoid valve 6. The second flow channel control section D comprises a spool valve 7. The second flow channel control section D may be of type I and type II in the first embodiment and the second embodiment, respectively. The second flow channel control section D in the first embodiment is of type I. The second flow channel control section D in the second embodiment is of type II. The second flow channel control section D of type II will be explained in the second embodiment of the present invention. The first embodiment of the present invention will be explained first.

A pump chamber 2 is formed in a metallic chassis 1 of the housing A. In FIG. 1, the pump section B, the first flow channel control section C and the second flow channel control section D (type I) are separated from each other, but may be housed spaced apart from each other or in an appropriate arrangement in one chassis 1. The pump chamber 2 has a driven gear unit chamber 2*a* configured in the form of a small-diameter passage section 21, a large-diameter passage section 22, a stepped surface portion 23 and an oil chamber 24 that are arrayed substantially along a straight line (FIG. 1).

The stepped surface portion 23 is formed to have a flat surface. A drive gear unit chamber 2*b* is formed adjacent to the driven gear unit chamber 2*a*. The drive gear unit chamber 2*b* comprises a drive gear receiving section 25, and a shaft hole 26 formed above and below the drive gear receiving section 25.

Figure 2A:
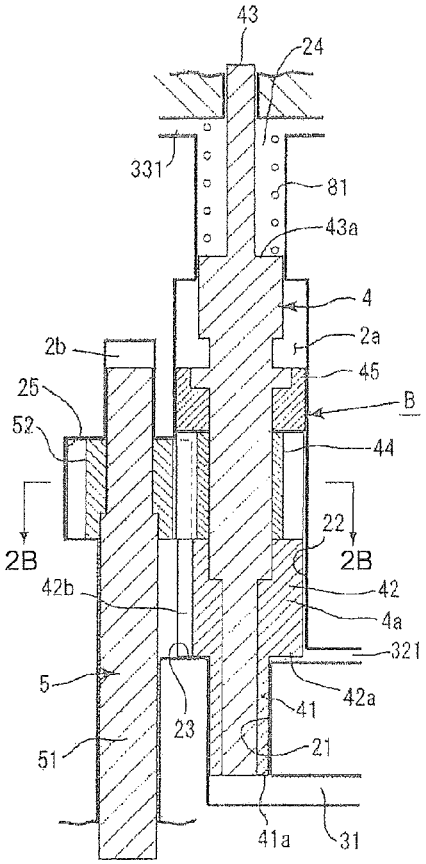
FIG. 2A is a schematic cross-sectional diagram of a state of maximum meshing area between a drive gear and a driven gear of a pump section.
Figure 2C:
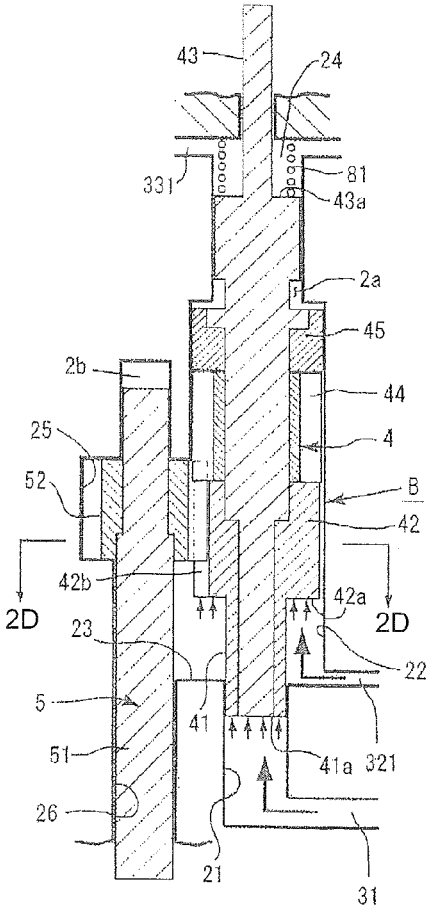
FIG. 2C is a schematic cross-sectional diagram of a state of minimum meshing area between a drive gear and a driven gear of a pump section.
Figure 2B:
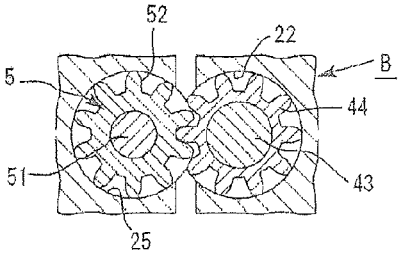
FIG. 2B is a cross-sectional diagram viewed from arrow 2B-2B of FIG. 2A.

In the present invention, the up-and-down direction of the housing A is not particularly limited, but to make the explanation easier to comprehend, the passage direction of the driven gear unit chamber 2*a* will be herein the up-and-down direction, such that in a case where the large-diameter passage section 22 is set to stand higher up than the small-diameter passage section 21, the upward direction is the direction towards the side of the large-diameter passage section 22 (FIG. 1 and FIGS. 2A, 2C).

The driven gear unit 4 is formed of a valve piston 4*a*, a driven shaft 43, a driven gear 44 and a partition piston 45 (FIGS. 2A, 2C). The valve piston 4*a* is formed integrating the small-diameter section 41 and the large-diameter section 42 with each other in the axial direction. The small-diameter section 41 is formed to a substantially cylindrical shape. The large-diameter section 42 has a substantially semi-circular or concave circular arc-shaped recess 42*b* formed at part of the outer peripheral side face.

Figure 2D:
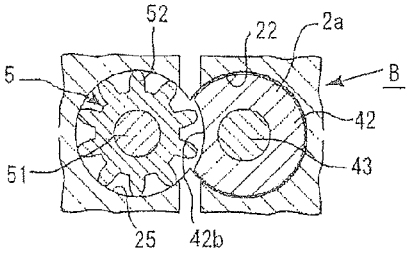
FIG. 2D is a cross-sectional diagram viewed from arrow 2D-2D of FIG. 2C.

The recess 42*b* is a portion into which the outer peripheral portion of a drive gear 52 intrudes when the driven gear 44 moves in the axial direction with respect to the drive gear 52 (FIGS. 2C, 2D). Such a configuration serves to prevent the drive gear 52 and the valve piston 4*a* from interfering with each other.

The valve piston 4*a* is used in a state where the axial direction thereof runs vertically, with the small-diameter section 41 at the bottom and the large-diameter section 42 at the top. The lower end of the small-diameter section 41 is a main pressure-receiving surface 41*a*. A stepped section formed at the boundary between the small-diameter section 41 and the large-diameter section 42 constitutes an auxiliary pressure-receiving surface 42*a*. The top face of the driven shaft 43 is used as a return pressure-receiving surface 43*a* (FIGS. 2A, 2C).

The drive gear unit 5 comprises the drive shaft 51 and the drive gear 52 (FIG. 1 and FIGS. 2A, 2C). In the drive gear unit 5, the drive gear 52 is accommodated in the drive gear receiving section 25, and the drive shaft 51 is rotatably supported in the shaft hole 26 and accommodated in the drive gear unit chamber 2*b*. The drive shaft 51 rotates on account of the motive power from an engine crankshaft, not shown. The drive gear 52, which rotates together with the drive shaft 51, works as a gear pump by transmitting the rotation of the drive shaft 51 to the driven gear 44.

A spring 81 that elastically urges the driven gear unit 4 in a discharge increase direction is fitted in the oil chamber 24 (FIG. 1 and FIGS. 2A, 2C). A coil spring is used as the spring 81, such that the spring exerts elastic urging so as to maximize the meshing area between the driven gear 44 and the drive gear 52.

The first flow channel control section C that controls the pump section B will be explained next. A main flow channel 31, and a first branching flow channel 32 are formed in the chassis 1. The main flow channel 31 is a flow channel formed so as to communicate from the exterior of the chassis 1 to the leading end face, at the lower side, of the small-diameter passage section 21 of the driven gear unit chamber 2*a* (FIG. 1, FIGS. 2A, 2C).

The leading end of the main flow channel 31 is formed in such a way so as to communicate with the leading end face (far-side face) of the small-diameter passage section 21 of the driven gear unit chamber 2*a*. That is, the leading end of the main flow channel 31 is configured in such a manner that the main pressure-receiving surface 41*a* (of the small-diameter section 41) of the valve piston 4*a* receives readily pressure from oil. Pressure from oil will be referred to hereafter as oil pressure.

The first branching flow channel 32 is formed branching from the main flow channel 31, inside the chassis 1. Part of the oil that flows through the main flow channel 31 flows into the first branching flow channel 32. The first branching flow channel 32 may be configured not as branching from the main flow channel 31, but in the form of an independent flow channel that is separate from the main flow channel 31, in the housing A.

A direction control section 61 of a below-described solenoid valve 6 is accommodated above the first branching flow channel 32 (on a side opposite the branching site). The solenoid valve 6 is mounted from outside the chassis 1. In order to assemble the solenoid valve 6, thus, the upper end portion of the first branching flow channel 32 runs through the surface of the chassis 1.

The first branching flow channel 32 communicates with the large-diameter passage section 22 of the driven gear unit chamber 2*a* via the first flow channel control section C. In the first branching flow channel 32, the flow channel between the first flow channel control section C and the large-diameter passage section 22 is referred to as first connection flow channel 321. The first connection flow channel 321 belongs to the first branching flow channel 32, and is a constituent part of the first branching flow channel 32.

Figures 3A, 3B, 3C, 3D:
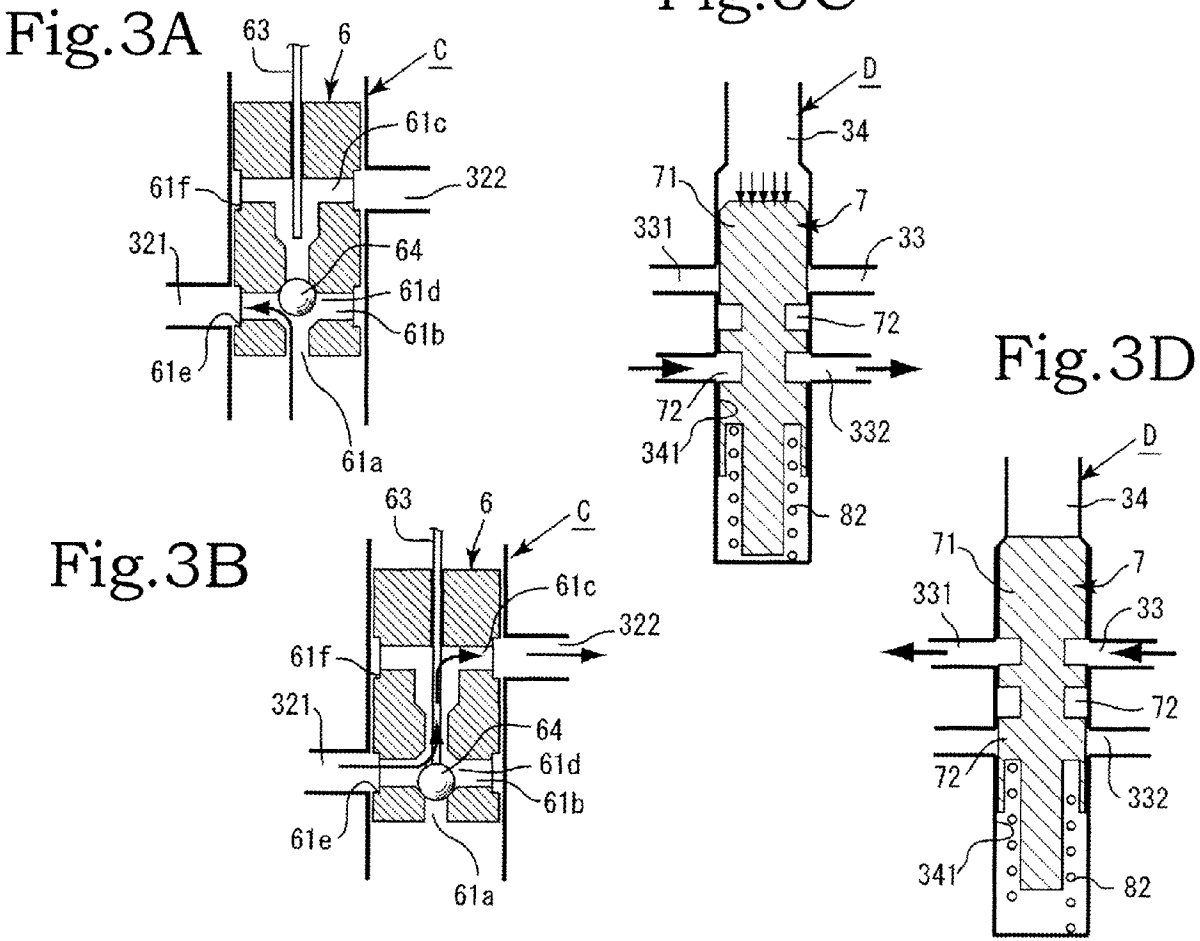
FIG. 3A is a schematic cross-sectional diagram of a communication state of a first branching flow channel elicited by a first flow channel control section in the first embodiment.
FIG. 3B is a schematic cross-sectional diagram of a shut-off state of the first branching flow channel elicited by the first flow channel control section of the first embodiment.
FIG. 3C is a schematic cross-sectional diagram of a shut-off state of a second branching flow channel elicited by a second flow channel control section in the first embodiment.
FIG. 3D is a schematic cross-sectional diagram of a communication state of the second branching flow channel elicited by the second flow channel control section in the first embodiment.

The first branching flow channel 32 is configured so as to be switched, by the first flow channel control section C, between communicating with and being shut off from the large-diameter passage section 22 (FIGS. 3A, 3B). A first discharge flow channel 322 is formed from the first branching flow channel 32 via the first flow channel control section C. The first discharge flow channel 322 has the role of returning oil to an intake side of the pump chamber 2 of the pump section B. The openings of the first connection flow channel 321 and the first discharge flow channel 322 inward of the first branching flow channel 32 are formed so as to be encompassed within the solenoid valve chamber 323.

The first flow channel control section C performs control of switching, by means of the solenoid valve 6, between communication with and shut-off from the first branching flow channel 32 (FIGS. 3A, 3B). The solenoid valve 6 comprises the direction control section 61 and an electromagnetic control section 62. The direction control section 61 is accommodated in the solenoid valve chamber 323 formed in the first branching flow channel 32, and part of the electromagnetic control section 62 is mounted on a recessed placement section 11 that is formed in the chassis 1.

An O-ring for hermetically dividing the oil passage is provided between the solenoid valve chamber 323 and the direction control section 61 of the solenoid valve 6. The O-ring prevents oil leaks. The solenoid valve 6 is fixed to the housing A by some fixing means, for instance by screwing or the like. The solenoid valve 6 has the role of controlling the oil flow direction in the first branching flow channel 32. By way of the direction control section 61, there is controlled switching between communication and shut-off between the first branching flow channel 32 and the large-diameter passage section 22, as well as oil discharge through communication between the first connection flow channel 321 and the first discharge flow channel 322.

The control operation of the solenoid valve 6 is performed by the electromagnetic control unit 62. When there is selected either communication between the first connection flow channel 321 and the first branching flow channel 32, or communication between the first connection flow channel 321 and the first discharge flow channel 322, the other communication path of the two is in a shut-off state such that no oil can flow.

The direction control section 61 of the solenoid valve 6 has a cylindrical shape, and is accommodated inside the solenoid valve chamber 323, which is a cylindrical cavity having substantially the same diameter (FIGS. 3A, 3B). The direction control section 61 has an axial-direction control flow channel 61*a*, a first diameter-direction control flow channel 61*b* and a second diameter-direction control flow channel 61*c*. The axial-direction control flow channel 61*a* has an oil inflow opening at an end face of the axial-direction lower end of the direction control section 61, such that part of the oil that flows through the main flow channel 31 flows into the first branching flow channel 32.

The first diameter-direction control flow channel 61*b* and the second diameter-direction control flow channel 61*c* are formed, along the axial direction, at two dissimilar sites, at the top and the bottom, such that the first diameter-direction control flow channel 61*b* is positioned at the bottom and the second diameter-direction control flow channel 61*c* is positioned at the top. The first diameter-direction control flow channel 61*b* and the second diameter-direction control flow channel 61*c* communicate with each other via the axial-direction control flow channel 61*a*. The site at which there intersect the axial-direction control flow channel 61*a* and the first diameter-direction control flow channel 61*b*, standing below, constitutes a valve chamber 61*d*. A spherical valve member 64 is accommodated in the valve chamber 61*d*.

The lower-side first diameter-direction control flow channel 61*b* communicates with the first connection flow channel 321. The upper-side second diameter-direction control flow channel 61*c* communicates with the first discharge flow channel 322. At the outer periphery of the direction control section 61 there is formed an outer peripheral groove 61*e* that extends around in one circle and that has, as the diameter thereof, both end portions of the first diameter-direction control flow channel 61*b*. At the outer periphery of the direction control section 61 there is formed also a outer peripheral groove 61*f* that extends around in one circle and that has, as the diameter thereof, both end portions of the second diameter-direction control flow channel 61*c*.

The outer peripheral grooves 61*e*, 61*f* allow the direction control section 61 to be arranged freely in a rotation direction. Ordinarily, the valve member 64 is pressed towards the bottom of the valve chamber 61*d* by an operating shaft 63, with the solenoid valve 6 in an off state, such that communication between the axial-direction control flow channel 61*a* and the lower-side first diameter-direction control flow channel 61*b* is shut off, and no oil can flow in (FIG. 3B).

The electromagnetic control unit 62 has the operating shaft 63 that reciprocates so as to rise and descend along the axial direction. This operation is elicited through electromagnetic control by the electromagnetic control section 62. By descending, the operating shaft 63 causes the valve member 64 to be pressed downward, thereby shutting off inflow oil (FIG. 3B). The valve member 64 is released, so that oil can flow into the direction control section 61, through rising of the operating shaft 63 (FIG. 3B).

The second flow channel control section D of type I is explained next. Flow channel control is performed in the second flow channel control section D (type I) by way of the spool valve 7 (FIG. 1 and FIGS. 3C, 3D). A second branching flow channel 33 and a return flow channel 34 are formed in the chassis 1 of the housing A. The return flow channel 34 is positioned upstream of the second branching flow channel 33. A spool valve receiving chamber 341 in which the spool valve 7 is accommodated is formed in the return flow channel 34.

The second branching flow channel 33 communicates with the oil chamber 24 of the pump chamber 2. In the second branching flow channel 33, a flow channel between the second flow channel control section D (type I) and the oil chamber 24 is referred to as second connection flow channel 331. The second connection flow channel 331 belongs to the second branching flow channel 33, and is a constituent part of the second branching flow channel 33.

The second branching flow channel 33 is configured so as to be switched, by the second flow channel control section D (type I), between, communicating and being shut off. A second discharge flow channel 332 is formed from the second branching flow channel 33 via the second flow channel control section D (type I). The second discharge flow channel 332 has the role of returning oil to the intake side of the pump chamber 2 of the pump section B.

Grooves 72 are formed along the peripheral direction of a shaft-like valve body 71 of the spool valve 7. The elastic urging force of the spring 82 in the spool valve 7 maintains normally a state wherein the second branching flow channel 33 is communicating and the second discharge flow channel 332 is shut off. When the oil pressure of the oil flowing into the return flow channel 34 exceeds a predetermined value, the spool valve 7 is pressed and caused to move, whereupon the spool valve 7 shuts off the second branching flow channel 33, so that the oil chamber 24 and the second discharge flow channel 332 communicate then with each other.

The direction control action of the first flow channel control section C is explained next. The pump device of the present invention is built into an oil circulation flow channel S of an engine 100. Oil flows from the oil circulation flow channel S into the main flow channel 31 of the housing A. The oil that flows into the main flow channel 31 communicates with the small-diameter passage section 21 of the driven gear unit chamber 2*a*, such that the oil, as-is, presses against the main pressure-receiving surface 41*a* of the valve piston 4*a*.

Part of the oil that flows into the main relief flow channel 31 flows into the first branching flow channel 32. The direction of the oil that flows into the first branching flow channel 32 is controlled by the solenoid valve 6, such that the first branching flow channel 32 and the large-diameter passage section 22 of the pump chamber 2 are brought to a communication (open) or shut-off (closed) state to/from each other.

When the solenoid valve 6 is off, the operating shaft 63 of the electromagnetic control unit 62 is in a state of pressing downward the valve member 64 in the direction control unit 61, such that the inlet between the first branching flow channel 32 and the axial-direction control flow channel 61*a* in the valve chamber 61*d* is shut-off. Inflow of oil through the first branching flow channel 32 is discontinued as a result.

Herein, the large-diameter passage section 22, the first connection flow channel 321 and the first discharge flow channel 322 communicate with each other. As a result, the large-diameter passage section 22 is linked to the atmosphere, the space in the large-diameter passage section 22 becomes no longer hermetic, and the motion direction of the valve piston 4*a* is not hampered. The oil discharged through the first discharge flow channel 322 returns to the intake side of the pump section B.

When the solenoid valve 6 is switched on, the operating shaft 63 of the electromagnetic control section 62 rises, and pressing exerted by the operating shaft 63 on the valve member 64 in the direction control section 61 is released. The valve member 64 is brought thus to a free state. As a result, the inlet between the first branching flow channel 32 and the axial-direction control flow channel 61*a* in the valve chamber 61*d* can be opened, whereupon the momentum of oil inflow from the first branching flow channel 32 causes the valve member 64 to rise up, and oil flows into the direction control section 61.

In the valve chamber 61*d*, the valve member 64 shuts off the opening through which the lower-side first diameter-direction control flow channel 61*b* and the upper-side second diameter-direction control flow channel 61*c* communicate with each other. As a result, the first branching flow channel 32, the first connection flow channel 321 and the large-diameter passage section 22 communicate now with each other, and oil is fed into the large-diameter passage section 22, so that the oil can press against the auxiliary pressure-receiving surface 42*a* of the valve piston 4*a*.

The direction control action of the second flow channel control section D of type I is explained next. Elastic urging by the spring 82 in the spool valve 7 keeps the second branching flow channel 33 in a communicating state and the second discharge flow channel 332 in a shut-off state. That is, the second discharge flow channel 332 is shut off at a time where the second branching flow channel 33 communicates with the oil chamber 24. Therefore, oil flows into the oil chamber 24, and oil pressure acts, together with the spring 81, on the return pressure-receiving surface 43*a* of the driven gear unit 4.

If the urging force of the spring 81 and the oil pressure that acts on the return pressure-receiving surface 43*a* on the oil chamber 24 side constitute a force that is greater than the oil pressure that acts on the main pressure-receiving surface 41*a* on the main flow channel 31 side, then the driven gear unit 4 remains on the small-diameter passage section 21 side, the meshing area between the drive gear 52 and the driven gear 44 is greatest, and the discharge volume is an ordinary one.

When the pressure of oil in the oil circulation flow channel S rises and exceeds a predetermined value, the oil that flows into the return flow channel 34 presses the spool valve 7 and causes the latter to move. As a result, the second branching flow channel 33 becomes shut off, and the oil chamber 24 and the second discharge flow channel 332 communicate then with each other. In this state, no oil flows into the second branching flow channel 33, and the driven gear unit 4 is pressed in the oil chamber 24 by the spring 81 alone.

As a result, the force of the oil pressure on the main pressure-receiving surface 41*a* on the main flow channel 31 side becomes greater than the urging force of the spring 81 that acts on the return pressure-receiving surface 43*a* on the oil chamber 24 side. Thereupon, the driven gear unit 4 moves towards the oil chamber 24, and the meshing area between the drive gear 52 and the driven gear 44 decreases, so that the discharge volume is reduced. When the driven gear unit 4 moves towards the oil chamber 24, the oil in the oil chamber 24 is discharged through the second discharge flow channel 332, and the discharged oil returns to the intake side of the pump section B.

Figure 5:
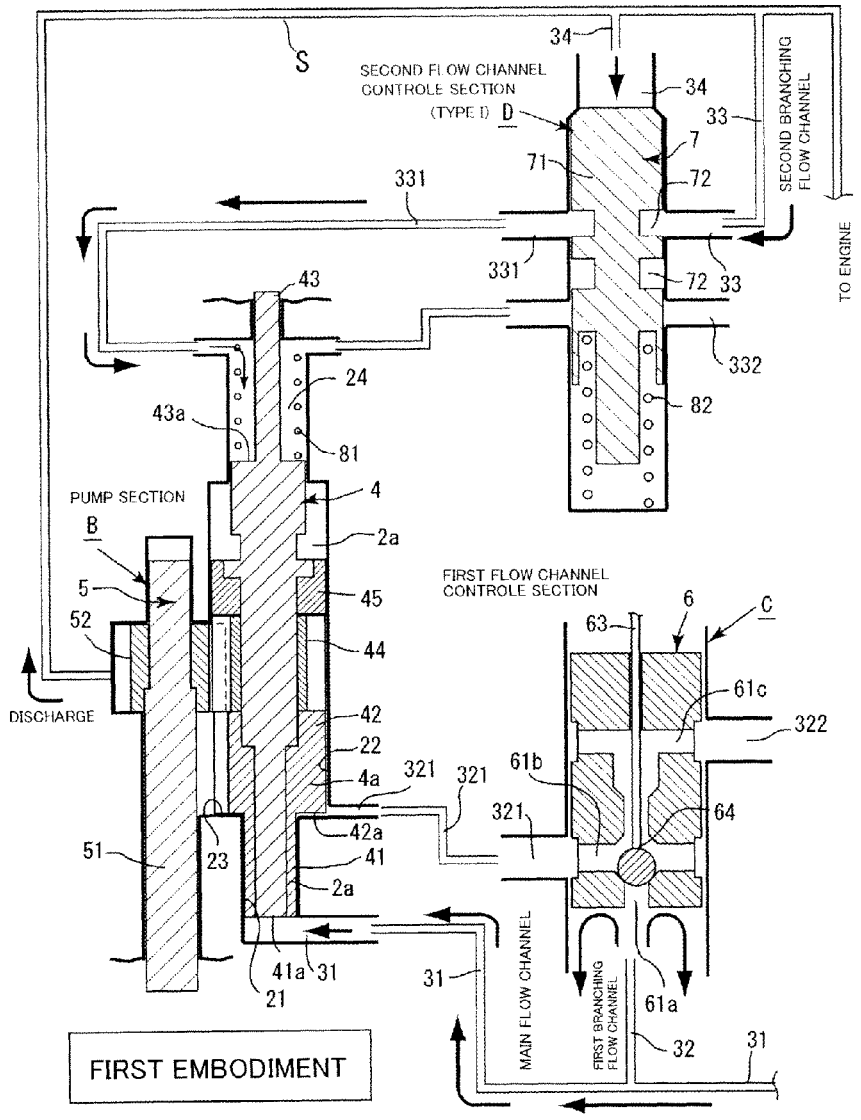
FIG. 5 is a schematic cross-sectional diagram illustrating the operation in a low revolution range of an engine in the first embodiment of the present invention.

The operation of the present invention will be explained next for various revolution ranges of the engine 100. The pump device of the present invention affords an appropriate discharge volume in the pump section B in accordance with the revolutions Ne of the engine 100. The discharge volume varies between a low revolution range, medium revolution range, and high revolution range of the revolutions Ne. An operation will be explained first for a low revolution range of the engine revolutions Ne (FIG. 5).

The low revolution range extends from 0 (zero) revolutions Ne to about 1000 rpm. In the first flow channel control section C, the solenoid valve 6 is brought to an off state according to an operation command. In the electromagnetic control section 62, the operating shaft 63 presses the valve member 64, as a result of which communication between the first branching flow channel 32 and the axial-direction control flow channel 61*a* is shut off.

The large-diameter passage section 22 accommodated in the large-diameter section 42, the first connection flow channel 321 and the first discharge flow channel 322 communicate then with each other. As a result, the large-diameter passage section 22 becomes open so as to communicate with the atmosphere (FIG. 3B). The pressure of the oil is such that only oil flowing through the main flow channel 31 acts on the main pressure-receiving surface 41*a* of the valve piston 4*a* (FIG. 2A).

In the second flow channel control section D (type I), the oil pressure acting on the spool valve 7 on account of oil flowing into the return flow channel 34 is just a small discharge pressure, since the engine revolutions are low revolutions. The spool valve 7 remains thus substantially in an initial state, and the second branching flow channel 33 remains in a state of communicating with the oil chamber 24, so that oil is supplied to the oil chamber 24.

The second discharge flow channel 332 is shut off, and hence the oil pressure and the elastic urging force of the spring 81 act on the return pressure-receiving surface 43*a* in the oil chamber 24. Since revolutions are low, and the discharge pressure acts only on the main pressure-receiving surface 41*a* from the main flow channel 31, the force that acts on the return pressure-receiving surface 43*a* is greater than the force acting on the main pressure-receiving surface 41*a*. The driven gear unit 4 remains thus in the initial state without moving in the axial direction. Changeover has not started yet.

Figure 6:
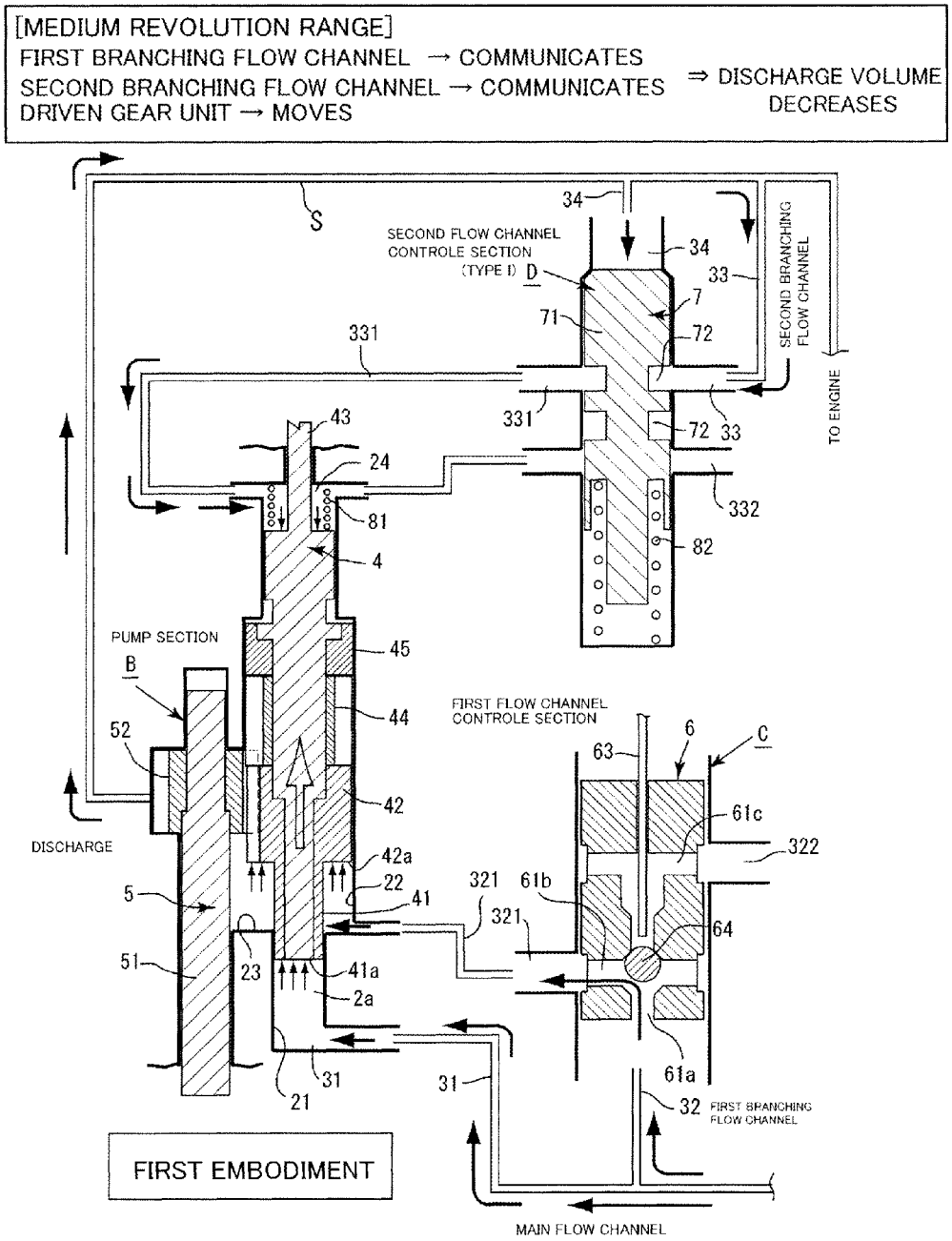
FIG. 6 is a schematic cross-sectional diagram illustrating the operation in a medium revolution range of an engine in the first embodiment of the present invention.

An operation will be explained next for a medium revolution range of the engine 100 (FIG. 6). In a medium revolution range, the revolutions Ne take on a value from about 1000 rpm to about 3500 rpm. The solenoid valve 6 of the first flow channel control section C is switched on at the point in time where the engine revolutions reach a predetermined value Ne1 (about 1000 rpm). Thereupon, the solenoid valve 6 performs switching so as to cause the first branching flow channel 32 and the large-diameter passage section 22 to communicate with each other, whereupon the auxiliary pressure-receiving surface 42*a* and the first branching flow channel 32 become linked to each other. Oil pressure acts now on both the main pressure-receiving surface 41*a* and the auxiliary pressure-receiving surface 42*a*, and there increases the pressure-receiving area of the valve piston 4*a*.

At this stage, the pressure has not reached yet a set pressure at which there moves the spool valve 7 of the second flow channel control section D (type I). Therefore, the force of the spring 81 and the discharge pressure act on the return pressure-receiving surface 43*a*, without switching of the oil passage by the spool valve 7. As a result of the increased pressure receiving area of the valve piston 4*a*, the force acting on the valve piston 4*a* becomes greater than the force acting on the return pressure-receiving surface 43*a*, and the driven gear unit 4 moves towards the oil chamber 24. Changeover starts thus.

In the process whereby the revolutions Ne rise from about 1000 rpm to about 3500 rpm, the solenoid valve 6 in the first flow channel control section C is on, in the same way as described above, and the first branching flow channel 32 and the large-diameter passage section 22 are in a state of communicating with each other. Oil pressure acts both on the main pressure-receiving surface 41*a* and on the auxiliary pressure-receiving surface 42*a* of the valve piston 4*a*.

In the second flow channel control section D (type I), the pressure has not reached the set pressure at which spool valve 7 moves. Therefore, a state is maintained in which the force of the spring 81 and discharge pressure act on the return pressure-receiving surface 43*a*. Accordingly, the relationship of forces between the small-diameter passage section 21 side and the oil chamber 24 side remains unchanged, and the driven gear unit 4 keeps on moving accompanying the rise in revolutions. The meshing area between the drive gear 52 and the driven gear 44 narrows as a result, and the theoretical discharge volume decreases gradually.

Figure 7:
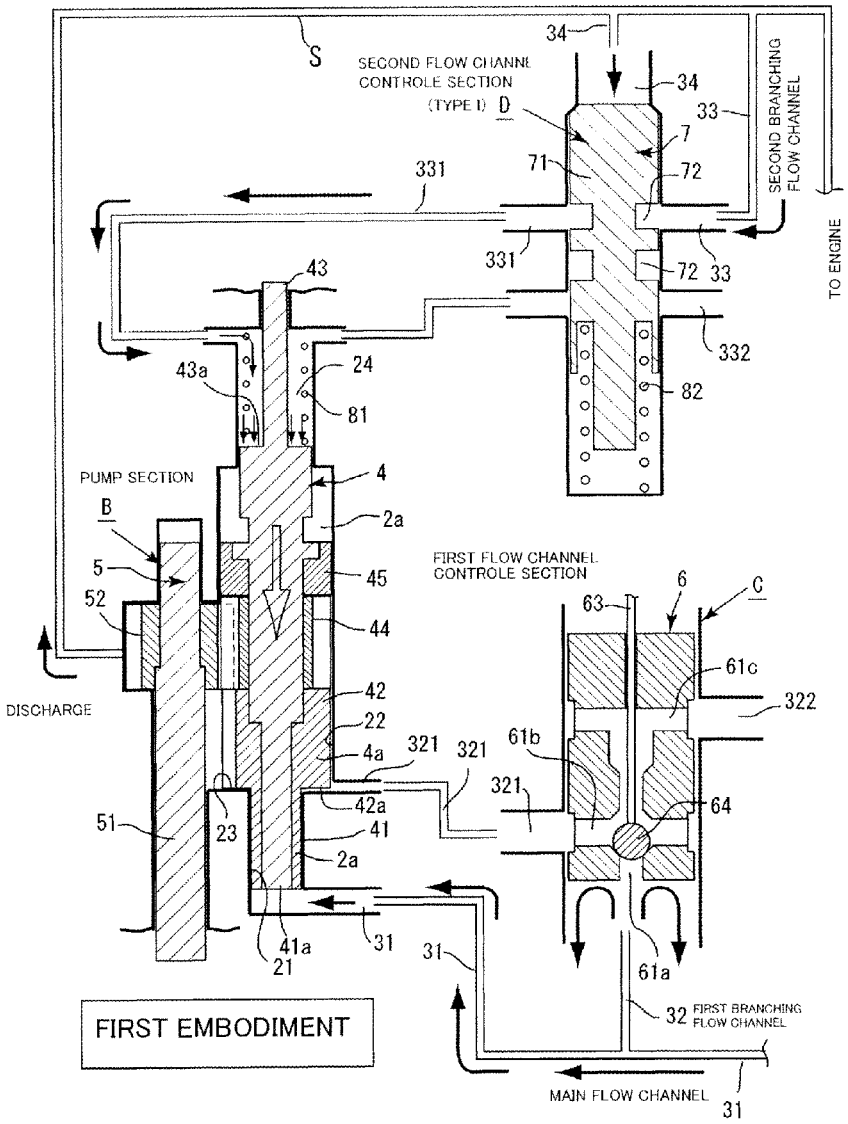
FIG. 7 is a schematic cross-sectional diagram illustrating the operation in a high revolution range of an engine in the first embodiment of the present invention.
Figure 8:
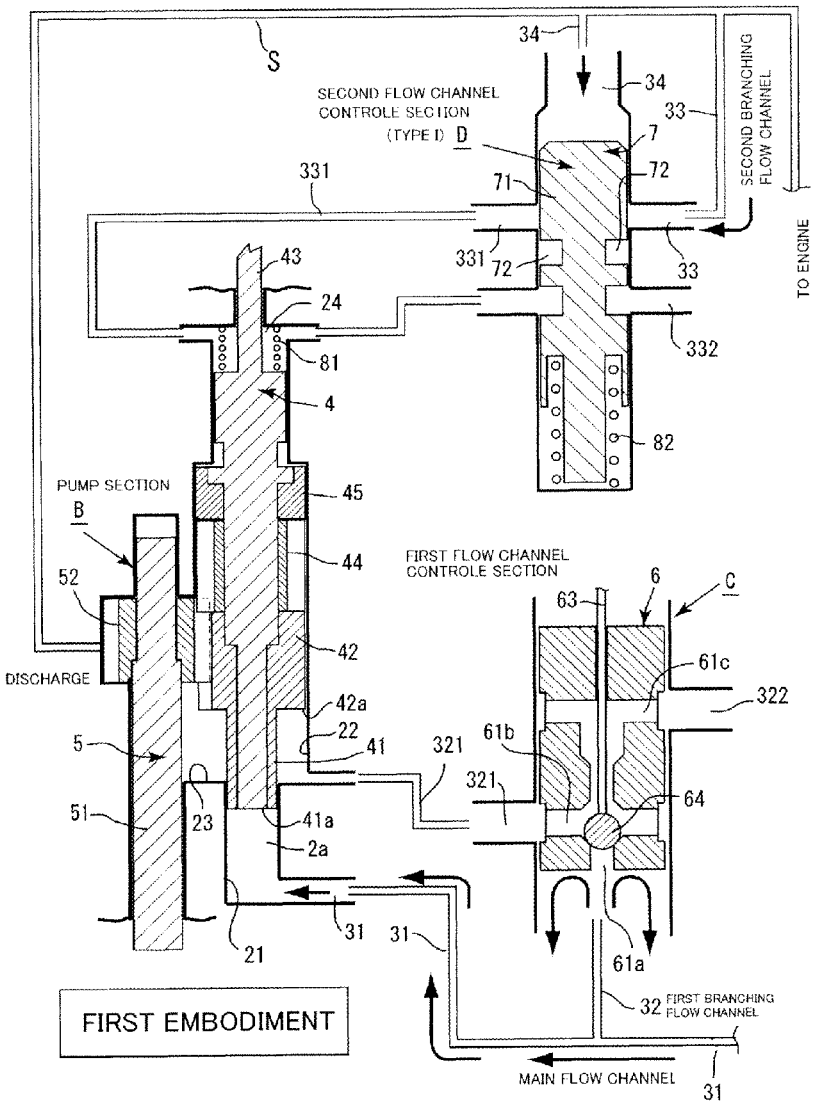
FIG. 8 is a schematic cross-sectional diagram illustrating the operation in a high revolution range, or higher, of an engine in the first embodiment of the present invention.

A relief operation in a high revolution range of revolutions Ne in the engine 100 will be explained next (FIG. 7, FIG. 8). The revolutions Ne in a high revolution range are about 3500 rpm or more. When the engine revolutions reach a predetermined value Ne2 (about 3500 rpm) (FIG. 7), the solenoid valve 6 in the first flow channel control section C is switched off once more. Thereupon, the first branching flow channel 32 and the large-diameter passage section 22 become shut off from each other, while the large-diameter passage section 22 and the first discharge flow channel 322 communicate now with each other. Oil in the large-diameter passage section 22 becomes discharged as a result through the first discharge flow channel 322, whereupon oil pressure acts now on the main pressure-receiving surface 41*a* alone, so that oil pressure decreases on the small-diameter passage section 21 side.

At this stage, the pressure has not reached yet a set pressure at which there moves the spool valve 7 of the second flow channel control section D (type I). Therefore, a state is maintained in which the force of the spring 81 and discharge pressure act on the return pressure-receiving surface 43*a* in the oil chamber 24. As a result of the decrease in the pressure-receiving area on the small-diameter passage section 21 side, the driven gear unit 4 moves towards the small-diameter passage section 21, the meshing area between the drive gear 52 and the driven gear 44 returns to an initial state, and the theoretical discharge volume increases to a normal one.

The discharge volume from the pump section B increases as a result, and the discharge pressure rises immediately, whereupon there is reached the set pressure (for instance, 600 kPa) at which the spool valve 7 moves. Motion of the spool valve 7 causes the second branching flow channel 33 and the oil chamber 24 to be shut off from each other, and the oil chamber 24 and the second discharge flow channel 332 to communicate with each other (FIG. 8).

In consequence, the only agent that exerts now pressure on the return pressure-receiving surface 43*a* is the spring 81. The oil pressure that acts on the main pressure-receiving surface 41*a* on the small-diameter passage section 21 side rises as well. Therefore, the driven gear unit 4 moves towards the oil chamber 24, as a result of which the meshing area between the drive gear 52 and the driven gear 44 narrows down, and the theoretical discharge volume decreases.

An explanation follows next on an instance where the engine revolutions exceed a high revolution region (FIG. 8). The solenoid valve 6 in the first flow channel control section C is off, oil pressure acts only on the main pressure-receiving surface 41*a*, and the spool valve 7 in the second flow channel control section D (type I) shuts off the second branching flow channel 33 and the oil chamber 24 from each other. Thus, no oil pressure acts on the return pressure-receiving surface 43*a* in the oil chamber 24; only the force of the spring 81 acts on the return pressure-receiving surface 43*a*.

In consequence, the pressing pressure derived from oil pressure on the main pressure-receiving surface 41*a* side of the driven gear unit 4 becomes predominant as the revolutions of the engine 100 rise. The driven gear unit 4 moves gradually as a result towards the oil chamber 24, the meshing area between the drive gear 52 and the driven gear 44 becomes narrower, and the theoretical discharge volume decreases gradually. It becomes thereby possible to prevent abnormal increases in discharge pressure force, even if revolutions exceed the high revolution range.

Figure 4:
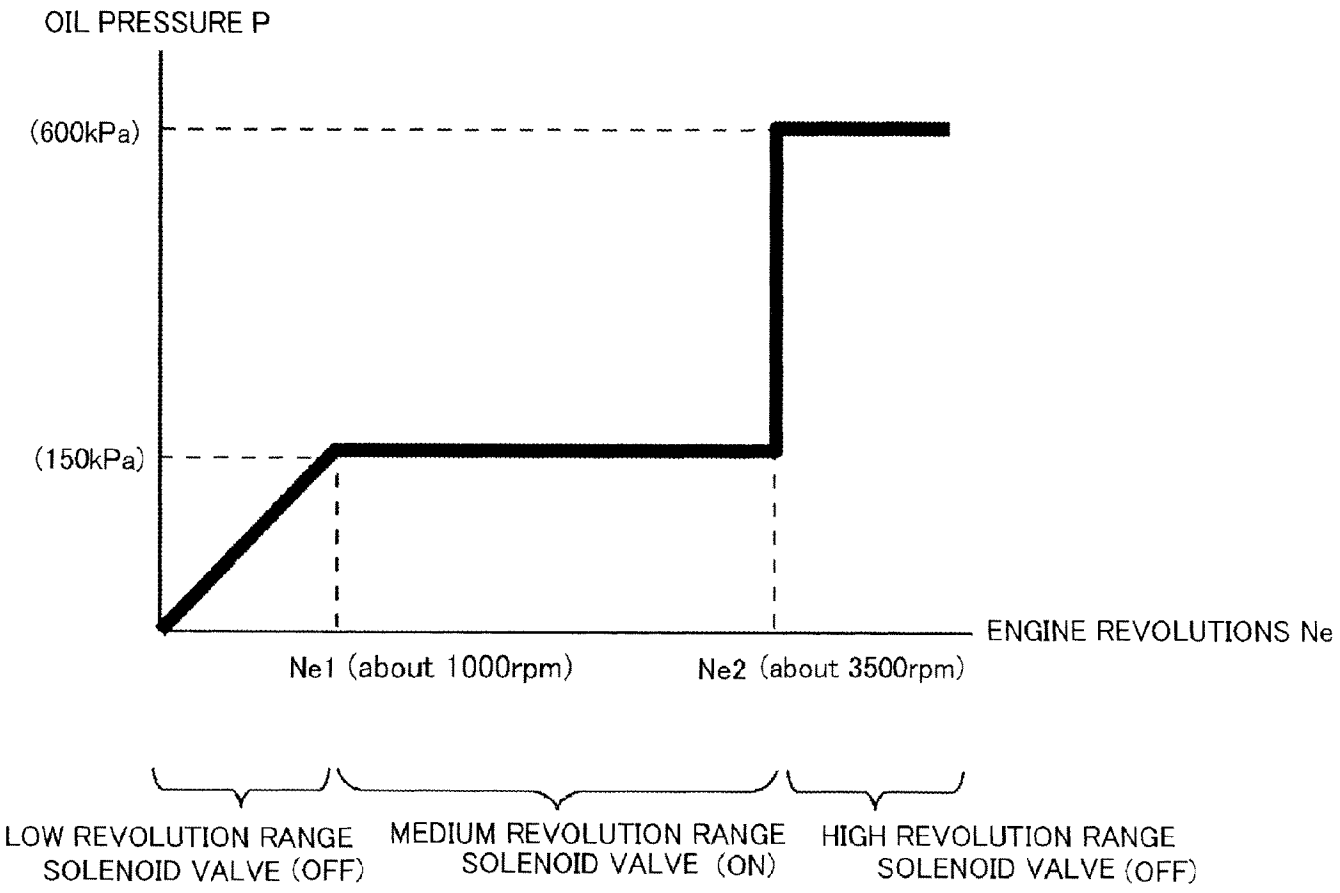
FIG. 4 is a graph illustrating the relationship between engine revolutions and oil pressure in a process of transition from a low revolution range to a high revolution range, in the first embodiment of the present invention.

FIG. 4 is a graph illustrating the state of oil pressure P in a low revolution range, a medium revolution range and a high revolution range of the revolutions Ne of the engine 100. In the present invention, as the graph of FIG. 4 clearly illustrates, the oil pressure P varies gradually from the beginning to the end of the medium revolution range, but rises promptly at the high revolution range. High oil pressure can thus be achieved.

Figures 14A, 14B, 14C, 14D:
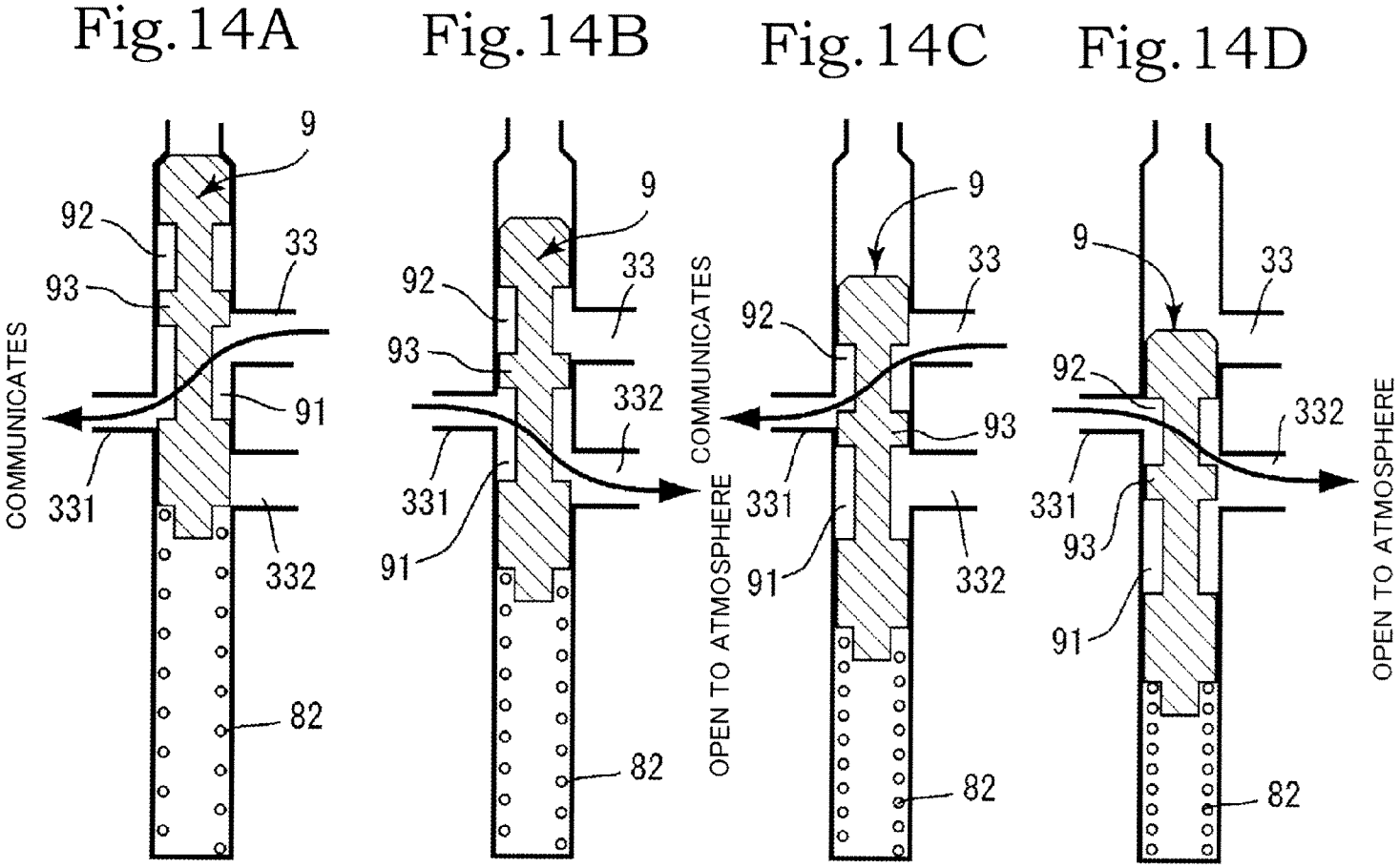
FIGS. 14A to 14D are diagrams illustrating the operation of a second flow channel control section of type II.

A second embodiment of the present invention is explained next. The second embodiment has substantially the same configuration of the first embodiment as regards the pump section B, the first flow channel control section C and the oil circulation flow channel S. The second flow channel control section D used herein is of type II, as mentioned above. The second flow channel control section D of type II is explained next. Herein, the reference numeral 9 is assigned to the spool valve of the second flow channel control section D of type II (FIG. 14).

A first communication groove 91, a second communication groove 92 and a intermediate shut-off section 93 are formed in the spool valve 9 of the second flow channel control section D. The first communication groove 91, the intermediate shut-off section 93, and the second communication groove 92 are formed in this order in the direction of frontward motion in the axial direction, from an initial position. That is, the intermediate shut-off section 93 is positioned between the first communication groove 91 and the second communication groove 92.

The first communication groove 91 is configured so as to elicit communication between the second branching flow channel 33 and the second connection flow channel 331, or between the second connection flow channel 331 and the second discharge flow channel 332. These two communication paths cannot occur simultaneously, and only one of either communication paths is effective at a given time (FIGS. 14A, 14B), the other communication path being shut off at that time by the intermediate shut-off section 93.

Likewise, the second communication groove 92 is configured so as to elicit communication only either between the second branching flow channel 33 and the second connection flow channel 331, or between the second connection flow channel 331 and the second discharge flow channel 332 (FIGS. 14C, 14D), the other communication path being shut off at that time by the intermediate shut-off section 93. Also, the first communication groove 91 and the second communication groove 92 cannot elicit communication simultaneously, and only one of them does so at a given time.

In the second embodiment, a changeover operation in which there is switched between increasing and decreasing the discharge volume at the pump section B, in a first and a second stage, involves performing a first stage changeover through switching control of the spool valve 9 of the second flow channel control section C based on oil pressure, and performing a second stage changeover through switching control of the solenoid valve 6 in the first flow channel control section C based on engine revolutions.

The second stage changeover may be performed through switching control of the solenoid valve 6 of the first flow channel control section C based on engine revolutions and through switching control of the spool valve 9 of the second flow channel control section D based on oil pressure. Herein, the first-stage changeover operation corresponds to a stage of change from a low revolution range to a medium revolution range, and a second-stage changeover operation corresponds to a stage of charge from a medium revolution range to a high revolution range.

The operation of the present invention for the discharge pressure of oil pump and the revolution range of the engine 100 is explained next. In the second embodiment of the present invention, the discharge volume in the pump section B is rendered yet more appropriate in accordance with the discharge pressure P of the oil pump and the revolutions Ne of the engine 100, such that the discharge volume varies across the various ranges (low revolution range, medium revolution range and high revolution range) of the revolutions Ne.

Figure 9:
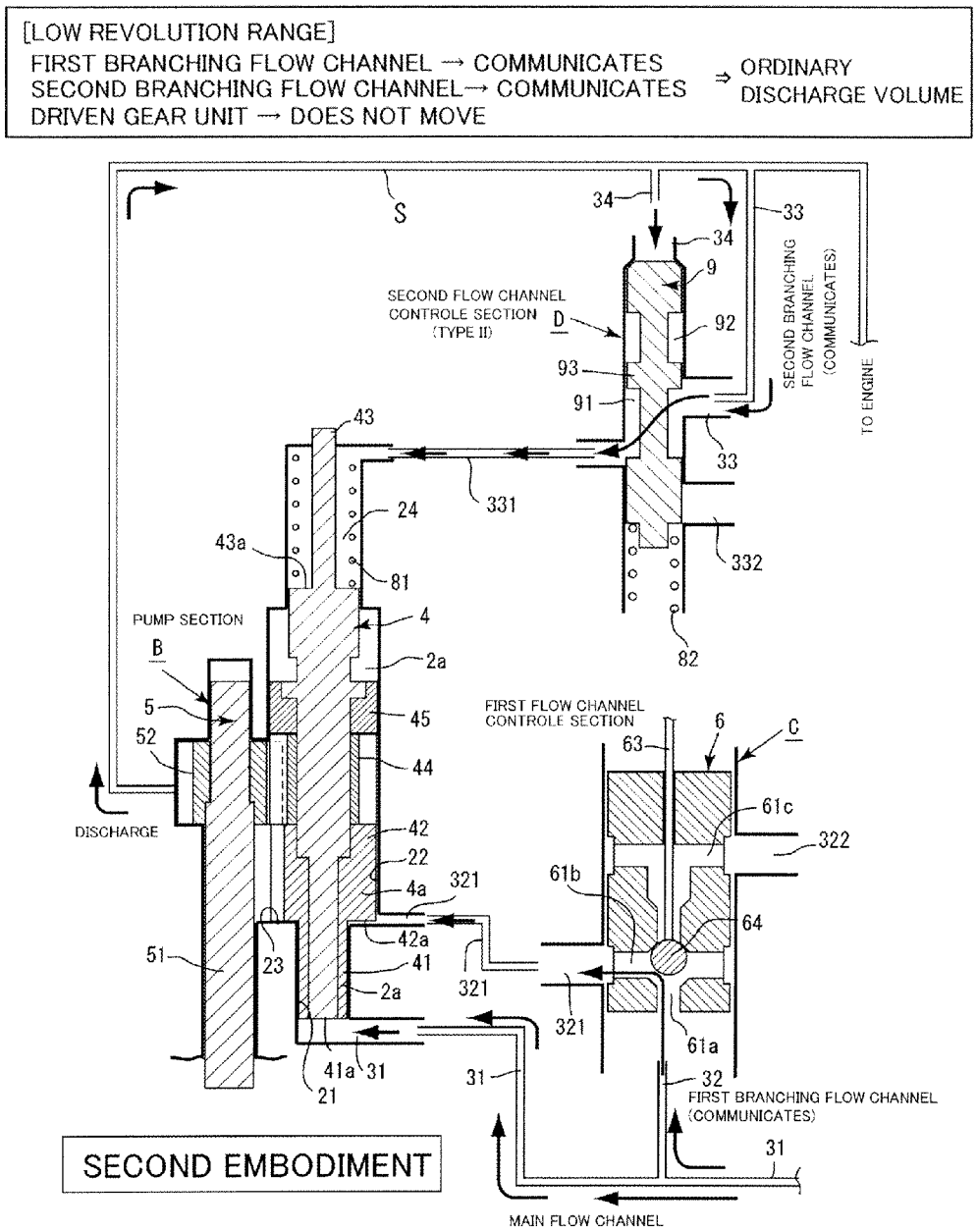
FIG. 9 is a schematic cross-sectional diagram illustrating the operation in a low revolution range of an engine in a second embodiment of the present invention.

The operation at a low revolution range will be explained first. In the low revolution range, at which time the discharge pressure P of the oil pump is smaller than 150 kPa (FIG. 9), the revolutions Ne take on a value from 0 (zero) rpm to about 1000 rpm. In the first-stage changeover operation, the solenoid valve 6 in the first flow channel control section C is brought to an on state according to an operation command. In the electromagnetic control section 62, the operating shaft 63 releases the valve member 64, whereupon the first branching flow channel 32 and the large-diameter passage section 22 communicate then with each other, and the auxiliary pressure-receiving surface 42*a* and the first branching flow channel 32 become linked to each other. Oil pressure acts both on the main pressure-receiving surface 41*a* and on the auxiliary pressure-receiving surface 42*a*.

In the second flow channel control section D (type II), the discharge pressure P in the oil pump is smaller than 150 kPa. Therefore, the oil pressure acting on the spool valve 9 on account of oil flowing into the return flow channel 34 is but a small discharge pressure. The spool valve 9 remains thus substantially in an initial state, the second branching flow channel 33 remains in a state of communicating with the oil chamber 24 via the second connection flow channel 331, and oil is supplied to the oil chamber 24. The second discharge flow channel 332 is shut off, and, therefore, oil in the oil chamber 24 is not open to the atmosphere, and oil pressure and the elastic urging force of the spring 81 act on the return pressure-receiving surface 43*a* in the oil chamber 24.

The force acting on the return pressure-receiving surface 43*a* of the driven gear unit 4 is greater than the force acting on the main pressure-receiving surface 41*a* and the auxiliary pressure-receiving surface 42*a*. The driven gear unit 4 remains thus in the initial state without moving in the axial direction. Changeover has not started yet. The first-stage changeover operation is an operation whereby revolutions increase in the low revolution range and reach eventually a below-described medium revolution range.

Figure 10:
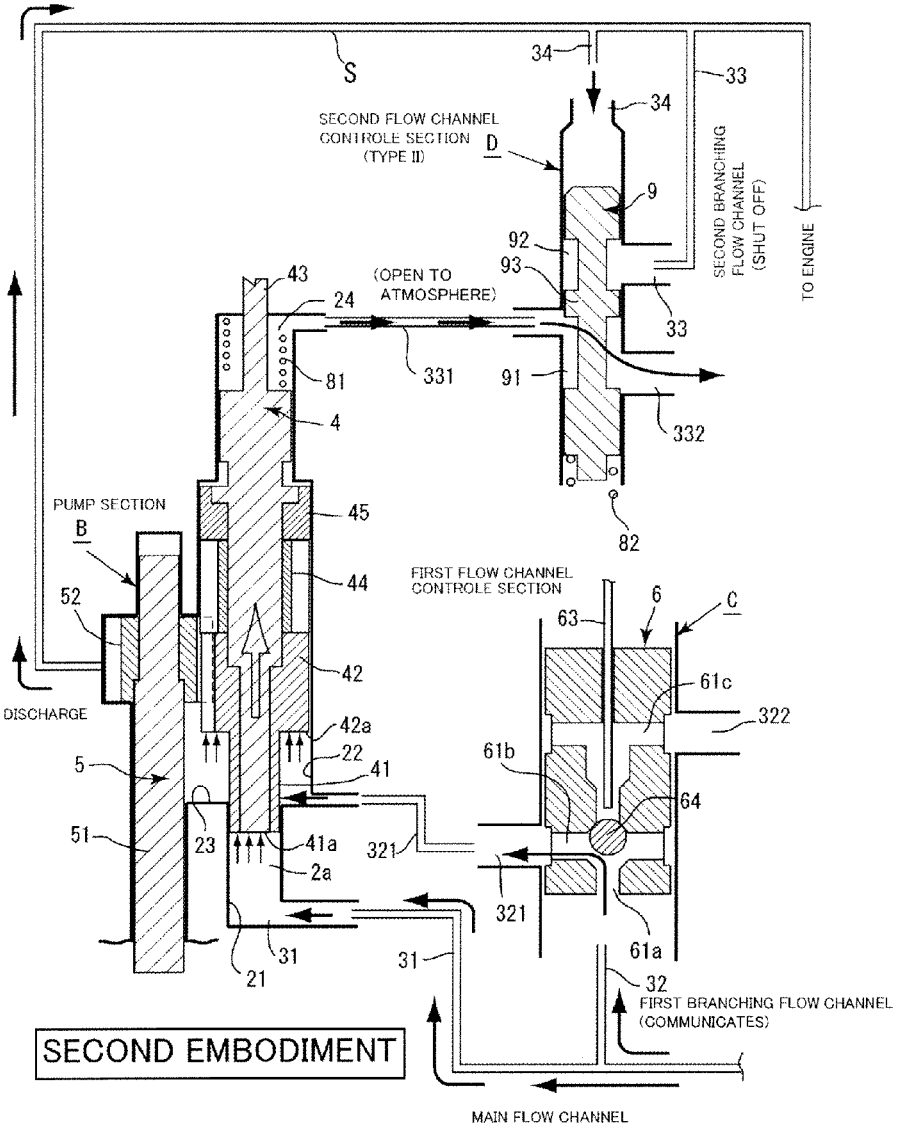
FIG. 10 is a schematic cross-sectional diagram illustrating the operation in a medium revolution range of an engine in the second embodiment of the present invention.

The operation at a time where the discharge pressure P of the oil pump is equal to or greater than 150 kPa (engine revolutions Ne in a medium revolution range) is explained next (FIG. 10). In a medium revolution range, the revolutions Ne take on a value from about 1000 rpm to about 3500 rpm. Firstly, the solenoid valve 6 in the first flow channel control section C remains switched on at the point in time at which the discharge pressure P in the oil pump reaches 150 kPa. Accordingly, the oil pressure acts both on the main pressure-receiving surface 41*a* and on the auxiliary pressure-receiving surface 42*a*.

When the discharge pressure P in the oil pump becomes equal to or greater than 150 kPa, the spool valve 9 is caused to move as a result, the second branching flow channel 33 and the oil chamber 24 become shut off from each other, and the oil chamber 24 and the second discharge flow channel 332 communicate then with each other via the second connection flow channel 331 (FIG. 10). As a result, the oil in the oil chamber 24 becomes open to the atmosphere, and the only agent that exerts pressure on the return pressure-receiving surface 43*a* is the spring 81. The force acting on the valve piston 4*a* becomes greater than the force acting on the return pressure-receiving surface 43*a* of the driven gear unit 4, and the driven gear unit 4 moves towards the oil chamber 24. Changeover starts thus.

In the first flow channel control section C, the solenoid valve 6 is switched on also during the process over which the revolutions Ne in the medium revolution range rise from about 1000 rpm to about 3500 rpm (process of reaching the below-described high revolution range). The first branching flow channel 32 and the large-diameter passage section 22 are in a state of communicating with each other via the first connection flow channel 321. Oil pressure acts both on the main pressure-receiving surface 41*a* and the auxiliary pressure-receiving surface 42*a* of the valve piston 4*a* of the driven gear unit 4.

The oil pressure from the return flow channel 34 is constant in the second flow channel control section D (type II), and the motion of the spool valve 9 is discontinued. At this time, the oil chamber 24 and the second discharge flow channel 332 communicate with each other. Therefore, a state is preserved in which oil in the oil chamber 24 is open to the atmosphere, and only the force of the spring 81 acts on the return pressure-receiving surface 43*a*. Accordingly, the relationship of forces between the small-diameter passage section 21 side and the oil chamber 24 side remains unchanged, and the driven gear unit 4 keeps on moving accompanying the rise in revolutions. The meshing area between the drive gear 52 and the driven gear 44 narrows as a result, and the theoretical discharge volume decreases gradually thereby.

Figure 11:
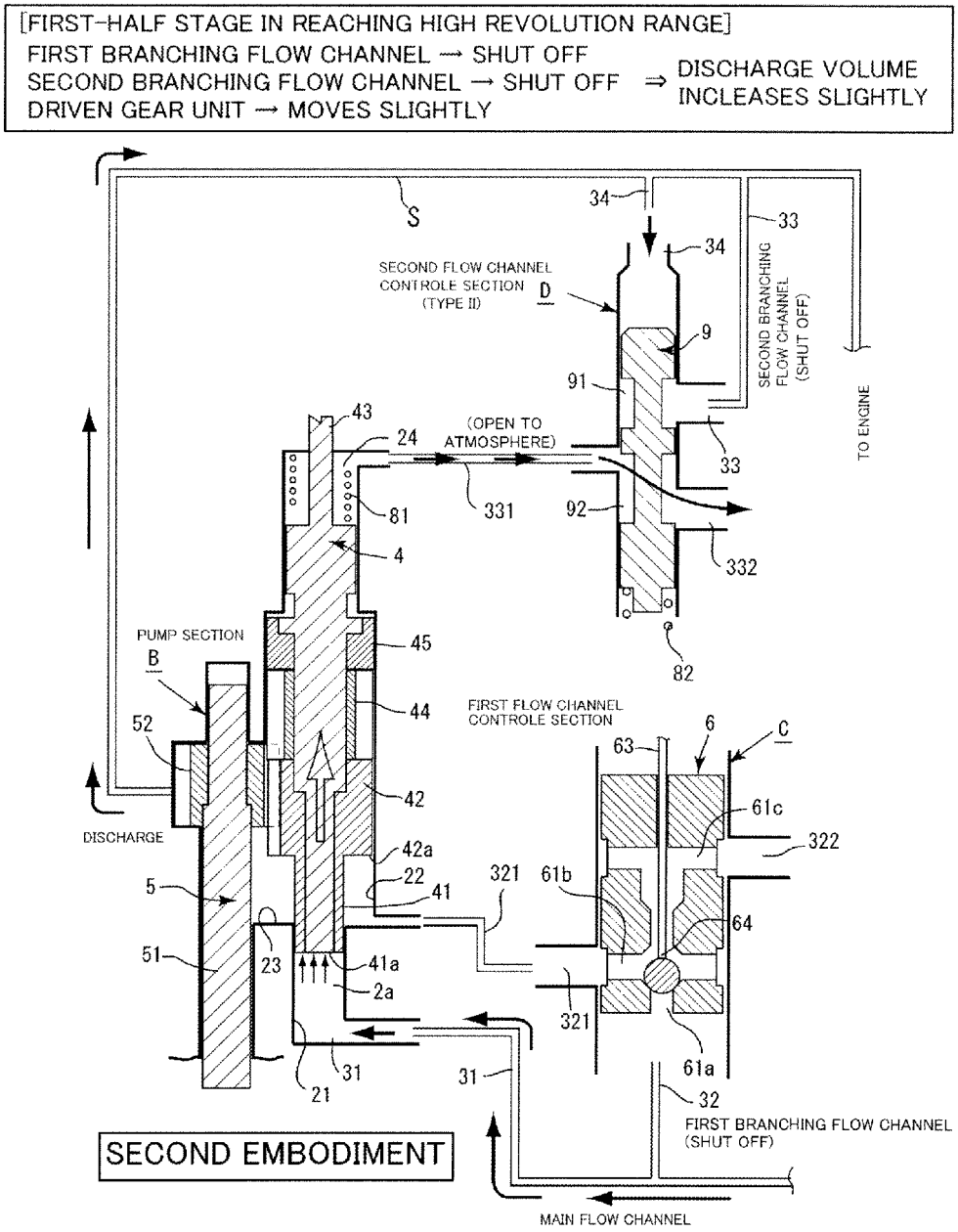
FIG. 11 is a schematic cross-sectional diagram illustrating the operation in a first-half stage of reaching a high revolution range of an engine in the second embodiment of the present invention.
Figure 12:
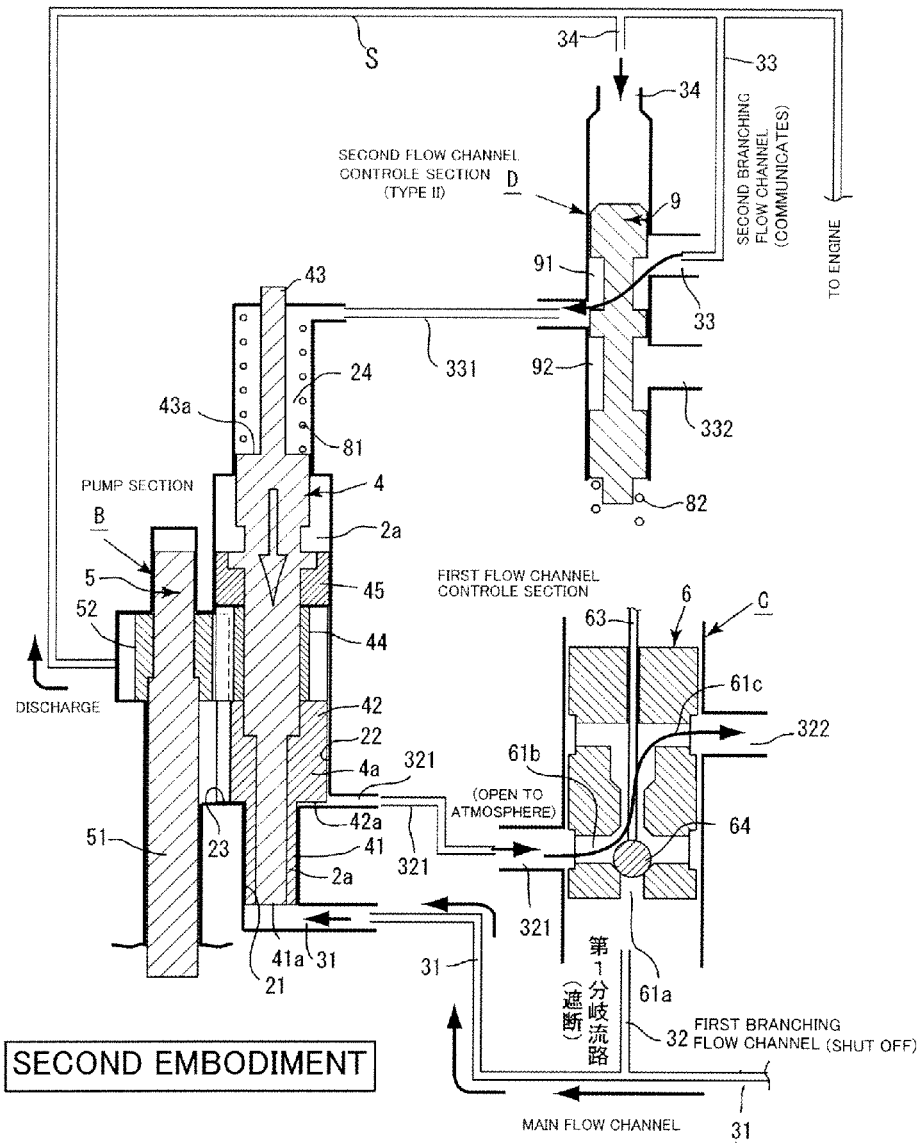
FIG. 12 is a schematic cross-sectional diagram illustrating the operation in a second-half stage of reaching a high revolution range of an engine in the second embodiment of the present invention.

An explanation follows next on an operation of a process in which the revolutions Ne of the engine 100 reach a high revolution range from a medium revolution range (FIG. 11 and FIG. 12). This corresponds to a second-stage changeover operation as mentioned above, i.e. corresponds to a process in which the engine revolutions reach a predetermined threshold value Ne2 (about 3500 rpm) from a medium revolution range (about 1000 rpm). In this process, operation switching takes place in two stages (first-half stage and second-half stage) (FIG. 11 and FIG. 12).

In a first-half stage, the solenoid valve 6 of the first flow channel control section C is switched off, whereby the first branching flow channel 32 and the large-diameter passage section 22 become shut off from each other, and the large-diameter passage section 22 and the first discharge flow channel 322 communicate then with each other, as illustrated in FIG. 11. As a result, oil in the large-diameter passage section 22 is discharged through the first discharge flow channel 322, oil pressure acts only on the main pressure-receiving surface 41*a*, and there decreases oil pressure on the small-diameter passage section 21 side.

In the first-half stage, the pressure has not reached yet a set pressure at which there moves the spool valve 9 of the second flow channel control section D (type II). Therefore, the spool valve 9 remains stopped at the current position. The force of the spring 81 alone acts on the return pressure-receiving surface 43*a* in the oil chamber 24. A smaller pressure-receiving area on the small-diameter passage section 21 side causes the driven gear unit 4 to move towards the small-diameter passage section 21, and causes the meshing area between the drive gear 52 and the driven gear 44 to return gradually to an initial state. The theoretical discharge volume increases ongoingly as a result.

In the second-half stage next, the increase in theoretical discharge volume occurred in the first-half stage brings about an increase in the pressure that the spool valve 9 receives from the return flow channel 34, and the spool valve 9 moves further. As a result, the second branching flow channel 33 and the oil chamber 24 communicate with each other once more (FIG. 12). Accordingly, the force of both the spring 81 and the discharge pressure act on the return pressure-receiving surface 43*a*, and the driven gear unit 4 moves further towards the small-diameter passage section 21. The theoretical discharge volume increases further as a result.

A set pressure (for instance, 600 kPa) is reached through further motion of the spool valve 9. As a result of the motion of the spool valve 9, the second branching flow channel 33 and the oil chamber 24 become shut off from each other, while the oil chamber 24 and the second discharge flow channel 332 communicate then with each other. Accordingly, the only element that exerts pressure on the return pressure-receiving surface 43*a* is the spring 81. Conversely, there rises the oil pressure that acts on the main pressure-receiving surface 41*a* on the small-diameter passage section 21 side, and hence the driven gear unit 4 moves towards the oil chamber 24, and the meshing area between the drive gear 52 and the driven gear 44 becomes smaller. The theoretical discharge volume decreases gradually as a result.

Figure 13:
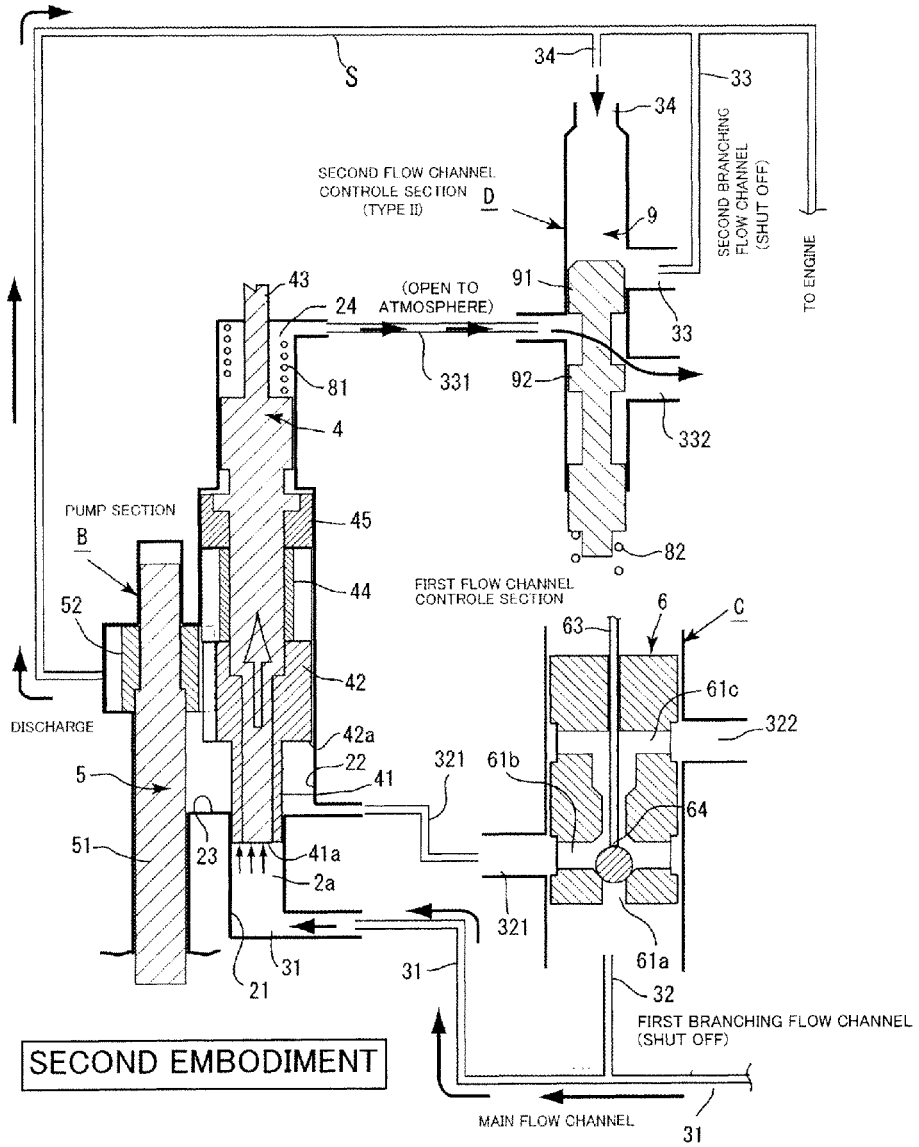
FIG. 13 is a schematic cross-sectional diagram illustrating the operation in a high revolution range, or higher, of an engine in the second embodiment of the present invention.

A high revolution range, in other words, an instance where engine revolutions further exceed a high revolution range will be explained next (FIG. 13). The revolutions Ne in a high revolution range are about 3500 rpm or more. The solenoid valve 6 in the first flow channel control section C is off, and oil pressure acts only on the main pressure-receiving surface 41*a*. The spool valve 9 in the second flow channel control section D (type II) shuts off the second branching flow channel 33 and the oil chamber 24 from each other. Thus, no oil pressure acts on the return pressure-receiving surface 43*a* in the oil chamber 24; only the force of the spring 81 acts on the return pressure-receiving surface 43*a*.

Accordingly, the pressing pressure derived from oil pressure on the main pressure-receiving surface 41*a* side of the driven gear unit 4 becomes predominant as the revolutions of the engine 100 rise. As a result, the driven gear unit 4 moves gradually towards the oil chamber 24, the meshing area between the drive gear 52 and the driven gear 44 becomes smaller, and the theoretical discharge volume decreases gradually. It becomes thereby possible to prevent abnormal increases in discharge pressure force, even if revolutions exceed the high revolution range.

In the second embodiment, as described above, a second stage changeover (process of reaching high revolutions) is performed through switching control of the solenoid valve 6 in the first flow channel control section C based on engine revolutions and switching control of the spool valve 9 in the second flow channel control section D based on oil pressure. In a variation of the second embodiment, the second stage changeover (process of reaching high revolutions) may be performed through switching control alone of the solenoid valve 6 in the first flow channel control section C based on engine revolutions. Two-stage changeover is also possible in this case even if there is no intermediate set pressure during motion of the spool valve 9 in the second flow channel control section D.

Figure 15:
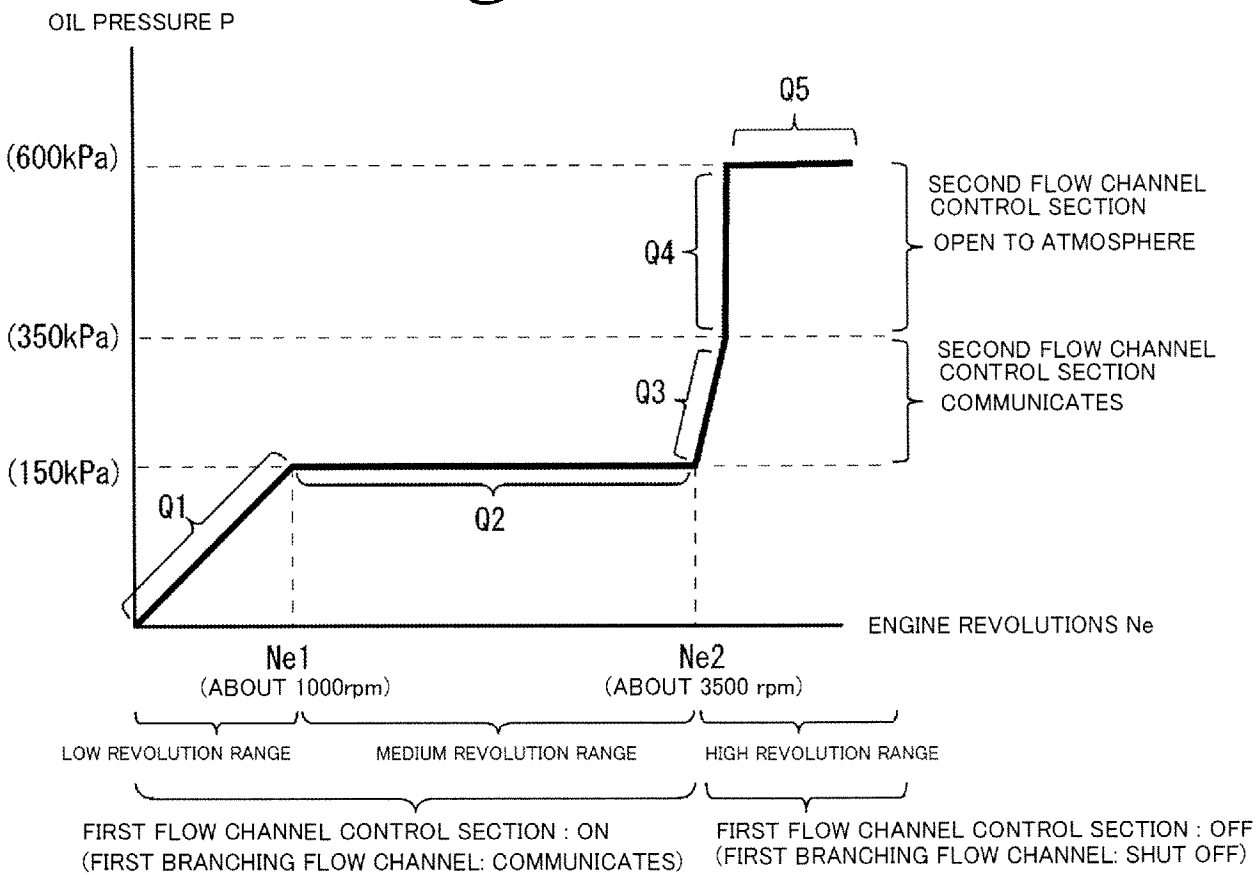
FIG. 15 is a graph illustrating the relationship between engine revolutions and oil pressure in a process of transition from a low revolution range to a high revolution range, in the second embodiment of the present invention.

FIG. 15 is a graph illustrating the state of oil pressure P in a low revolution range, a medium revolution range and a high revolution range of the revolutions Ne of the engine 100. The graph depicts five operation processes Q1, Q2, Q3, Q4 and Q5. Herein, Q1 corresponds to FIG. 9 that illustrates a low revolution range, Q2 corresponds to FIG. 10 that illustrates a medium revolution range, Q3 corresponds to FIG. 11 that illustrates a first-half stage of reaching a high revolution range, and Q4 corresponds to FIG. 12 that illustrates a second-half stage of reaching a high revolution range.

The process Q5 corresponds to FIG. 13 that illustrates a high revolution range or higher. As the graph of FIG. 15 shows, the present invention allows suppressing rises in oil pressure in a medium revolution range, such that the oil pressure P changes gently from the start to the end of the medium revolution range. No superfluous oil pressure is thus generated, and wasteful work can be reduced. In the high revolution range, the oil pressure P rises promptly, so that the required oil pressure can be secured.

What is claimed is:

1. A pump device, comprising:

a housing;

a pump section, a discharge volume of which is configured to be increased and reduced, and which includes a drive gear unit that is immobile in an axial direction and a driven gear unit that is movable in the axial direction;

a main flow channel through which oil pressure is applied to said driven gear unit in a discharge volume reduction direction;

a first branching flow channel through which oil pressure is applied to the driven gear unit in the discharge volume reduction direction, in addition to the oil pressure from the main flow channel;

a second branching flow channel through which oil pressure is applied to said driven gear unit in a discharge volume increase direction;

a first flow channel control section that is provided in the first branching flow channel and performs flow channel control of communication or shut-off of the first branching flow channel by a solenoid valve;

a second flow channel control section that is provided in the second branching flow channel and performs flow rate control of communication or shut-off of the second branching flow channel by a spool valve; and a spring that elastically urges said driven gear unit in the discharge volume increase direction, wherein the driven gear unit comprises a valve piston including a main pressure-receiving surface that receives the oil pressure from the main flow channel and an auxiliary pressure-receiving surface that receives the oil pressure from the first branching flow channel, and an axial-direction end portion of the driven gear unit on a side opposite to the valve piston across the driven gear includes a return pressure-receiving surface that receives oil pressure from the second branching flow channel, and wherein said first flow channel control section and said second flow channel control section perform control so as to switch between communication and shut-off between said first branching flow channel and said second branching flow channel in accordance with an increase or a decrease in engine revolutions and an increase or a decrease in pressure.

2. The pump device according to claim 1, wherein said driven gear unit includes:

a small-diameter passage section in which there is disposed the valve piston that includes a small-diameter section including the main pressure-receiving surface and a large-diameter section including the auxiliary pressure-receiving surface, with said small-diameter section being disposed in a driven gear unit chamber of said housing; and a large-diameter passage section in which said large-diameter section is disposed, and wherein said first branching flow channel communicates with said large-diameter passage section in a manner that oil pressure is configured to be applied to said auxiliary pressure-receiving surface, and said second branching flow channel communicates with a drive gear unit chamber in a manner that oil pressure is configured to be applied to the return pressure-receiving surface, which includes the axial-direction end portion of said driven gear unit.

3. The pump device according to 1, wherein the driven gear of said driven gear unit is formed to have an axial-direction total length dimension that is greater than that of a drive gear of said drive gear unit, and wherein, in an initial state in which the driven gear does not move in the axial direction, corners of the driven gear jut beyond corners of the drive gear in a direction of reducing the discharge volume when the driven gear moves in the axial direction.

4. The pump device according to claim 1, wherein, in a changeover operation in which a switchover is performed between increasing and decreasing the discharge volume at the pump section in a first stage and a second stage, a first stage changeover is performed through switching control of the spool valve of said second flow channel control section based on oil pressure, and a second stage changeover is performed through switching control of the solenoid valve of said first flow channel control section based on the engine revolutions.

5. The pump device according to claim 1, wherein, in a changeover operation in which a switchover is performed between increasing and decreasing the discharge volume at the pump section in a first stage and a second stage, a first stage changeover is performed through switching control of the spool valve of said second flow channel control section based on oil pressure, and a second stage changeover is performed through switching control of the solenoid valve of said first flow channel control section based on the engine revolutions, and through switching control of the spool valve of said second flow channel control section based on oil pressure.

6. The pump device according to 2, wherein the driven gear of said driven gear unit is formed to have an axial-direction total length dimension that is greater than that of the drive gear of said drive gear unit.

7. The pump device according to 1, wherein the driven gear of said driven gear unit is formed to have an axial-direction total length dimension that is greater than that of the drive gear of said drive gear unit.

8. The pump device according to claim 3, wherein, in a changeover operation in which a switchover is performed between increasing and decreasing the discharge volume at the pump section in a first stage and a second stage, a first stage changeover is performed through switching control of the spool valve of said second flow channel control section based on oil pressure, and a second stage changeover is performed through switching control of the solenoid valve of said first flow channel control section based on the engine revolutions.

9. The pump device according to claim 2, wherein, in a changeover operation in which a switchover is performed between increasing and decreasing the discharge volume at the pump section in a first stage and a second stage, a first stage changeover is performed through switching control of the spool valve of said second flow channel control section based on oil pressure, and a second stage changeover is performed through switching control of the solenoid valve of said first flow channel control section based on the engine revolutions.

10. The pump device according to claim 6, wherein, in a changeover operation in which a switchover is performed between increasing and decreasing the discharge volume at the pump section in a first stage and a second stage, a first stage changeover is performed through switching control of the spool valve of said second flow channel control section based on oil pressure, and a second stage changeover is performed through switching control of the solenoid valve of said first flow channel control section based on the engine revolutions.

11. The pump device according to claim 3, wherein, in a changeover operation in which a switchover is performed is performed between increasing and decreasing the discharge volume at the pump section in a first stage and a second stage, a first stage changeover is performed through switching control of the spool valve of said second flow channel control section based on oil pressure, and a second stage changeover is performed through switching control of the solenoid valve of said first flow channel control section based on the engine revolutions, and through switching control of the spool valve of said second flow channel control section based on oil pressure.

12. The pump device according to claim 2, wherein, in a changeover operation in which a switchover is performed is performed between increasing and decreasing the discharge volume at the pump section in a first stage and a second stage, a first stage changeover is performed through switching control of the spool valve of said second flow channel control section based on oil pressure, and a second stage changeover is performed through switching control of the solenoid valve of said first flow channel control section based on the engine revolutions, and through switching control of the spool valve of said second flow channel control section based on oil pressure.

13. The pump device according to claim 6, wherein, in a changeover operation in which a switchover is performed is performed between increasing and decreasing the discharge volume at the pump section in a first stage and a second stage, a first stage changeover is performed through switching control of the spool valve of said second flow channel control section based on oil pressure, and a second stage changeover is performed through switching control of the solenoid valve of said first flow channel control section based on the engine revolutions, and through switching control of the spool valve of said second flow channel control section based on oil pressure.

14. The pump device according to 2, wherein the driven gear of said driven gear unit is formed to have an axial-direction total length dimension that is greater than that of a drive gear of said drive gear unit, and wherein, in an initial state in which the driven gear does not move in the axial direction, corners of the driven gear jut beyond corners of the drive gear in a direction of reducing the discharge volume when the driven gear moves in the axial direction.

15. The pump device according to 1, wherein, in an initial state in which the driven gear does not move in the axial direction, corners of the driven gear jut beyond corners of a drive gear of said drive gear unit in a direction of reducing the discharge volume when the driven gear moves in the axial direction.

16. The pump device according to 1, wherein the auxiliary pressure-receiving surface receives the oil pressure from the first branching flow channel in the discharge volume reduction direction.

17. The pump device according to 1, wherein the valve piston includes a two-stage configuration of pressure-receiving surfaces including the main pressure-receiving surface and the auxiliary pressure-receiving surface, the oil pressure moving the driven gear unit in the discharge volume reduction direction being applied to the valve piston.

* * * * *